US011619028B2

(12) United States Patent
Izumikawa

(10) Patent No.: US 11,619,028 B2
(45) Date of Patent: Apr. 4, 2023

(54) SHOVEL

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 344 days.

(21) Appl. No.: 16/896,411

(22) Filed: Jun. 9, 2020

(65) Prior Publication Data

US 2020/0299935 A1 Sep. 24, 2020

Related U.S. Application Data

(63) Continuation of application No. PCT/JP2018/045556, filed on Dec. 11, 2018.

(30) Foreign Application Priority Data

Dec. 11, 2017 (JP) ..... JP2017-237185

(51) Int. Cl.

| | |
|---|---|
| ***E02F 9/26*** | (2006.01) |
| ***E02F 3/42*** | (2006.01) |
| ***E02F 9/20*** | (2006.01) |
| ***E02F 9/22*** | (2006.01) |

(52) U.S. Cl.

CPC ..... *E02F 9/26* (2013.01); *E02F 3/422* (2013.01); *E02F 9/2025* (2013.01); *E02F 9/22* (2013.01)

(58) Field of Classification Search

CPC . E02F 3/422; E02F 9/2025; E02F 9/22; E02F 9/26; E02F 9/262

See application file for complete search history.

(56) References Cited

U.S. PATENT DOCUMENTS

| | | | | |
|---|---|---|---|---|
| 7,483,814 | B2 | 1/2009 | Hoshi et al. | |
| 9,464,409 | B2 | 10/2016 | Magaki et al. | |
| 10,147,339 | B2 | 12/2018 | Kozumi et al. | |
| 2006/0026101 | A1* | 2/2006 | Ogura | E02F 9/26 705/50 |
| 2006/0212203 | A1* | 9/2006 | Furuno | E02F 9/26 701/50 |
| 2006/0287841 | A1* | 12/2006 | Hoshi | E02F 9/26 702/182 |

(Continued)

FOREIGN PATENT DOCUMENTS

| | | |
|---|---|---|
| JP | S62-121244 | 6/1987 |
| JP | H06-089550 | 3/1994 |

(Continued)

OTHER PUBLICATIONS

International Search Report for PCT/JP2018/045556 dated Jan. 29, 2019.

*Primary Examiner* — Tyler J Lee

(74) *Attorney, Agent, or Firm* — IPUSA, PLLC

(57) ABSTRACT

A shovel includes a cabin, a display device attached to the cabin, and a main pump. An internal combustion is configured to drive the main pump. An information acquiring device is provided. A controller is configured to calculate an amount of work based on the information acquired by the information acquiring device and to cause the display device to display the amount of work per predetermined period of time in a chronological order.

18 Claims, 19 Drawing Sheets

(56) References Cited

U.S. PATENT DOCUMENTS

| | | | | |
|---|---|---|---|---|
| 2008/0195365 | A1* | 8/2008 | Ohkura | E02F 9/26 703/2 |
| 2008/0319710 | A1 | 12/2008 | Hsu et al. | |
| 2010/0245542 | A1 | 9/2010 | Kim et al. | |
| 2011/0227744 | A1* | 9/2011 | Shibata | G07C 5/085 340/679 |
| 2011/0276261 | A1* | 11/2011 | Mizutani | B66C 13/18 701/123 |
| 2012/0065874 | A1* | 3/2012 | Sato | B60R 16/0236 701/123 |
| 2012/0185159 | A1* | 7/2012 | Yamauchi | G01F 15/0755 701/123 |
| 2017/0052518 | A1* | 2/2017 | Wang | G05B 11/01 |
| 2017/0255895 | A1 | 9/2017 | Kozumi et al. | |
| 2018/0218304 | A1 | 8/2018 | Shike | |

FOREIGN PATENT DOCUMENTS

| | | |
|---|---|---|
| JP | H10-212740 | 8/1998 |
| JP | 2002-004336 | 1/2002 |
| JP | 2002-004337 | 1/2002 |
| JP | 2005-098988 | 4/2005 |
| JP | 2008-241300 | 10/2008 |
| JP | 2010-235027 | 10/2010 |
| JP | 2014-148891 | 8/2014 |
| JP | 2014-190090 | 10/2014 |
| JP | 2015-209691 | 11/2015 |
| JP | 6002873 | 10/2016 |
| JP | 2016-223201 | 12/2016 |
| JP | 2017-071916 | 4/2017 |
| JP | 2017-172316 | 9/2017 |
| WO | 2016/125915 | 8/2016 |

* cited by examiner

SHOVEL

RELATED APPLICATIONS

This patent application is a continuation of International Patent Application No. PCT/JP2018/045556, filed on Dec. 11, 2018, which is based upon and claims priority to Japanese Patent Application No. 2017-237185, filed on Dec. 11, 2017, the entire content of each of which is incorporated herein by reference.

BACKGROUND

1. Field of the Invention

The present disclosure relates to a shovel.

2. Description of the Related Art

Conventionally, a shovel is known that is used to display the time change of fuel consumption per unit time on a display device.

However, how the shovel is used cannot be indicated to the outside by simply displaying the time course of fuel consumption per unit time. This is because the amount of work implemented at the same fuel consumption greatly differs depending on how the work is prepared, handled and the like.

Therefore, it is desirable to present how the shovel is used in a more understandable manner.

SUMMARY OF THE INVENTION

A shovel according to an embodiment of the present disclosure includes a cabin, a display device attached to the cabin, and a main pump. An internal combustion is configured to drive the main pump. An information acquiring device is provided. A controller is configured to calculate an amount of work based on the information acquired by the information acquiring device and to cause the display device to display the amount of work per predetermined period of time in a chronological order.

DETAILED DESCRIPTION OF THE PREFERED EMBODIMENTS

Figure 1:
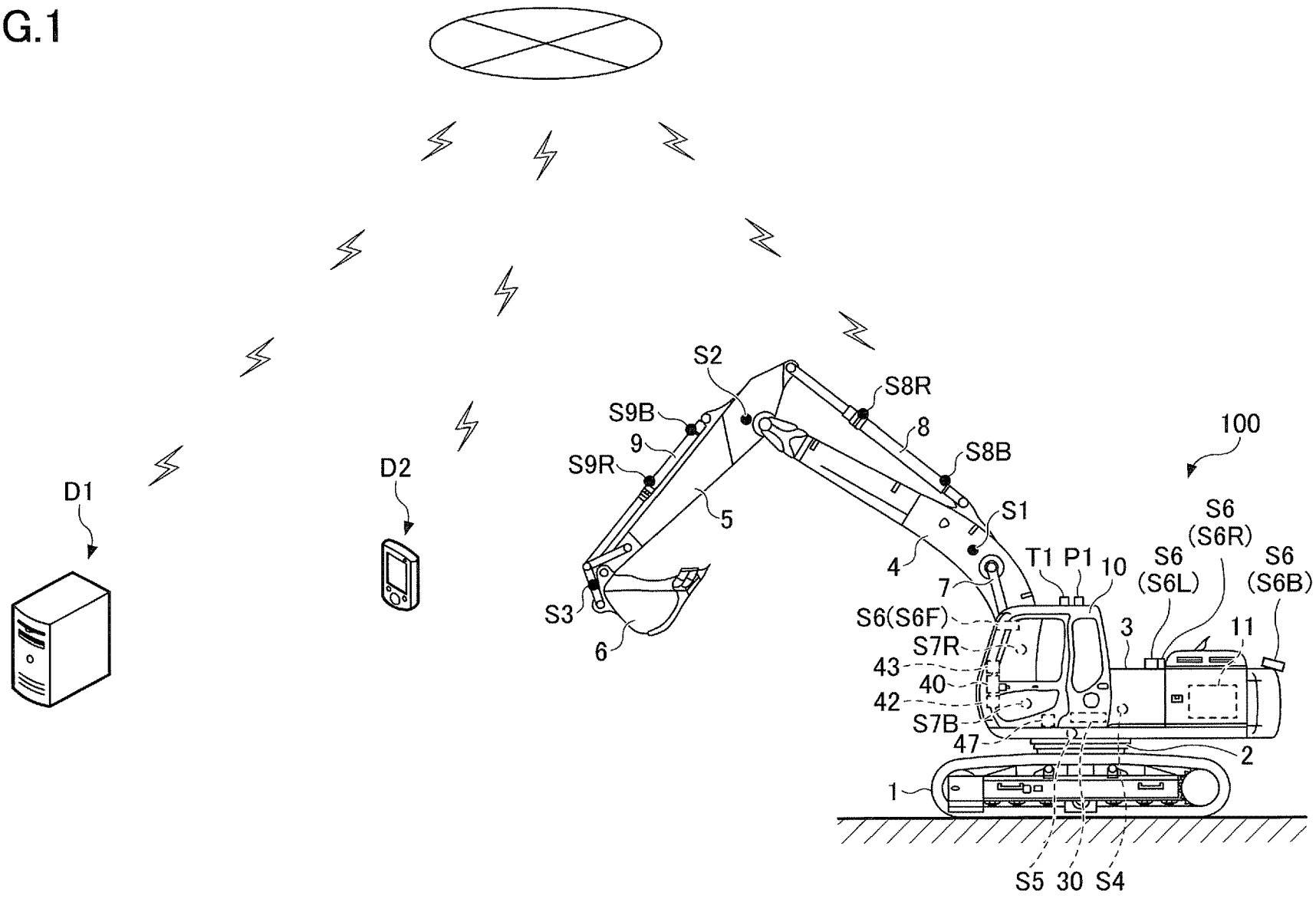
FIG. 1 is a side view of a shovel according to an embodiment of the present invention.

FIG. 1 is a side view of a shovel 100 as an excavator according to an embodiment of the present invention. An upper turning body 3 is rotatably mounted on a lower traveling body 1 of the shovel 100 through a turning mechanism 2. A boom 4 is attached to the upper turning body 3. An arm 5 is attached to the distal end of the boom 4, and a bucket 6 is attached to the distal end of the arm 5 as an end attachment.

The boom 4, arm 5, and bucket 6 constitute an excavating attachment as an example of the attachment. The boom 4 is driven by a boom cylinder 7, the arm 5 is driven by an arm cylinder 8, and the bucket 6 is driven by a bucket cylinder 9. A boom angle sensor S1 is mounted on the boom 4; an arm angle sensor S2 is mounted on the arm 5; and a bucket angle sensor S3 is mounted on the bucket 6.

The boom angle sensor S1 is configured to detect a rotation angle of the boom 4. In this embodiment, the boom angle sensor S1 is an acceleration sensor, and the rotation angle of the boom 4 relative to the upper turning body 3 (hereinafter, referred to as the "boom angle") can be detected. The boom angle becomes, for example, the minimum angle when the boom 4 is lowest, and increases as the boom 4 is raised.

The arm angle sensor S2 is configured to detect a rotation angle of the arm 5. In this embodiment, the arm angle sensor S2 is an acceleration sensor, and the rotation angle of the arm 5 with respect to the boom 4 (hereinafter, referred to as the "arm angle") can be detected. The arm angle becomes, for example, the minimum angle when the arm 5 is closed most, and increases as the arm 5 is opened.

The bucket angle sensor S3 is configured to detect the rotation angle of the bucket 6. In this embodiment, the bucket angle sensor S3 is an acceleration sensor, and the rotation angle of the bucket 6 with respect to the arm 5 (hereinafter, referred to as "bucket angle") can be detected. The bucket angle becomes, for example, the minimum angle when the bucket 6 is most closed, and increases as the bucket 6 is opened.

The boom angle sensor S1, the arm angle sensor S2, and the bucket angle sensor S3 may each be a potentiometer utilizing a variable resistor, a stroke sensor for detecting a stroke amount of a corresponding hydraulic cylinder, a rotary encoder for detecting a rotation angle around a coupling pin, a gyro sensor, or a combination of an acceleration sensor and a gyro sensor, and the like.

A boom rod pressure sensor S7R and a boom bottom pressure sensor S7B are attached to the boom cylinder 7. An arm rod pressure sensor S8R and an arm bottom pressure sensor S8B are attached to the arm cylinder 8. A bucket rod pressure sensor S9R and a bucket bottom pressure sensor S9B are attached to the bucket cylinder 9. The boom rod pressure sensor S7R, boom bottom pressure sensor S7B, arm rod pressure sensor S8R, arm bottom pressure sensor S8B, bucket rod pressure sensor S9R, and bucket bottom pressure sensor S9B are collectively referred to as "cylinder pressure sensors."

The boom rod pressure sensor S7R detects the pressure of the rod side oil chamber of the boom cylinder 7 (hereinafter referred to as "boom rod pressure"), and the boom bottom pressure sensor S7B detects the pressure of the bottom side oil chamber of the boom cylinder 7 (hereinafter referred to as "boom bottom pressure"). The arm rod pressure sensor S8R detects the pressure in the oil chamber at the rod side of the arm cylinder 8 (hereinafter referred to as "arm rod pressure"), and the arm bottom pressure sensor S8B detects the pressure in the oil chamber at the bottom side of the arm cylinder 8 (hereinafter referred to as "arm bottom pressure"). The bucket rod pressure sensor S9R detects the pressure of the oil chamber at the rod side of the bucket cylinder 9 (hereinafter referred to as "bucket rod pressure"), and the bucket bottom pressure sensor S9B detects the pressure of the oil chamber at the bottom side of the bucket cylinder 9 (hereinafter referred to as "bucket bottom pressure").

The upper turning body 3 includes a cabin 10 that is an operator's cab and includes a power source such as an engine 11. A controller 30, a display device 40, an input device 42, a sound output device 43, a storage device 47, a positioning device P1, an airframe inclination sensor S4, a turning angle sensor S5, an imaging device S6, and a communication device T1 are mounted on the upper turning body 3. The upper turning body 3 may include a power storage portion for supplying power and a motor-generator for generating power using the rotating drive force of the engine 11. The capacitor may be, for example, a capacitor or a lithium-ion battery. The motor-generator may act as a motor to drive the machine load, or it may act as a generator to supply power to the electric load.

The controller 30 functions as a main control unit for controlling the drive of the shovel 100. In this embodiment, the controller 30 is constituted of a computer including a CPU, RAM, ROM, and the like. Various functions of the controller 30 are implemented, for example, by executing a program stored in a ROM by a CPU. The various functions may include, for example, a machine guidance function that guides the operator's manual operation of the shovel 100 and at least one machine control function that automatically assists the operator's manual operation of the shovel 100.

The display device 40 is configured to display a variety pieces of information. The display device 40 may be connected to the controller 30 via a communication network such as a CAN or may be connected to the controller 30 via a dedicated line.

The input device 42 is configured to allow an operator to input various pieces of information to the controller 30. The input device 42 includes at least one of a touch panel, a knob switch, a membrane switch, and the like located within the cabin 10.

The sound output device 43 is configured to output a sound. The sound output device 43 may be, for example, an on-board speaker connected to the controller 30 or an alarm such as a buzzer. According to the present embodiment, the sound output device 43 is configured to output a variety of pieces of information by the sound output command from the controller 30.

The storage device 47 is configured to store a variety pieces of information. The storage device 47 is a non-volatile storage medium such as a semiconductor memory. The storage device 47 may store information output by the various devices during operation of the shovel 100 and may store information acquired through the various devices before operation of the shovel 100 is started. The storage device 47 may store, for example, data relating to the target construction surface acquired via the communication device T1 or the like. The target execution surface may be set by the operator of the shovel 100 or may be set by the construction administrator.

The positioning device P1 is configured to measure the position of the upper turning body 3. The positioning device P1 may be configured to measure the orientation of the upper turning body 3. In this embodiment, the positioning device P1 is, for example, a GNSS compass that detects the position and orientation of the upper turning body 3 and outputs the detected value to the controller 30. Therefore, the positioning device P1 can also function as an orientation detecting device for detecting the orientation of the upper turning body 3. The orientation detecting device may be an orientation sensor mounted on the upper turning body 3.

The airframe inclination sensor S4 is configured to detect the inclination of the upper turning body 3. In this embodiment, the airframe inclination sensor S4 is an acceleration sensor that detects a longitudinal inclination angle around the front and rear axes of the upper turning body 3 and a lateral inclination angle around the right and left axes with respect to the virtual horizontal plane. The front and rear and left and right axes of the upper turning body 3 are perpendicular to each other at the center of the shovel, which is a point on the turning axis of the shovel 100, for example.

The rotation angular velocity sensor S5 is configured to detect the rotation angular velocity of the upper turning body 3. The turning angular velocity sensor S5 may be configured to detect or calculate the turning angle of the upper turning body 3. In this embodiment, the turning angular velocity sensor S5 is a gyro sensor. The turning angular velocity sensor S5 may be a resolver, a rotary encoder, or the like.

The imaging device S6 is an example of a spatial recognition device and is configured to acquire an image around the shovel 100. In this embodiment, the imaging device S6 includes a front camera S6F for imaging the space in front of the shovel 100, a left camera S6L for imaging the space on the left side of the shovel 100, a right camera S6R for imaging the space on the right side of the shovel 100, and a rear camera S6B for imaging the space on the rear side of the shovel 100.

The imaging device S6 is, for example, a monocular camera having an imaging device such as a CCD or CMOS, and outputs the captured image to the display device 40. The imaging device S6 may be a stereo camera, a range imaging camera, or the like. The imaging device S6 may be also replaced by other spatial recognition devices, such as a three-dimensional range image sensor, an ultrasonic sensor, a millimeter wave radar, a LIDAR, or an infrared sensor, or may be replaced by a combination of another spatial recognition device and a camera.

The front camera S6F is mounted, for example, on the ceiling of the cabin 10, that is, inside the cabin 10. However, the front camera 6F may be mounted on the outside of the cabin 10, such as the roof of the cabin 10, the side surfaces of the boom 4, or the like. The left camera S6L is mounted to the upper left end of the upper turning body 3, the right camera S6R is mounted to the upper right end of the upper turning body 3, and the rear camera S6B is mounted to the upper rear end of the upper turning body 3.

The communication device T1 is configured to control communication with an external device external to the shovel 100. In the present embodiment, the communication device T1 controls communication with an external device through a satellite communication network, a cellular phone communication network, or an Internet network. The external device may be, for example, a management device D1, such as a server installed in an external facility, or a support device D2, such as a smartphone, carried by an operator around the shovel 100. The external device is configured to manage, for example, construction information for one or more shovels 100. The construction information includes, for example, information regarding at least one of an operating period of time, a fuel economy, and an amount of work of the shovel 100. The amount of work is, for example, the amount of earth and sand excavated and the amount of earth and sand loaded onto the dump truck's loading platform. The shovel 100 may be configured to transmit construction information regarding the shovel 100 to an external device through the communication device T1 at predetermined time intervals. With this configuration, an operator or administrator, and the like, outside the shovel 100 can view various pieces of information including construction information through a display device such as a monitor connected to the management device D1 or the support device D2.

The external device may be a communication device mounted on a dump truck including a load weight measuring device or may be a communication device connected to a truck scale for measuring the weight of the dump truck. In this case, the shovel 100 can obtain the weight of earth, sand and the like loaded on the dump truck's loading platform based on information from the dump truck or the truck scale.

Figure 13:
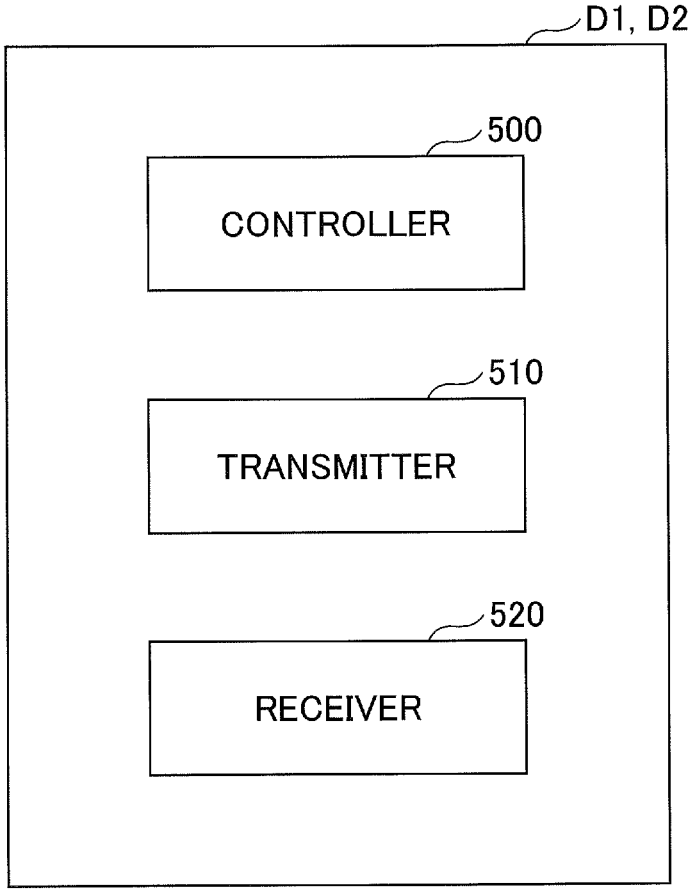
FIG. 13 is a schematic diagram illustrating a configuration of an external device according to an embodiment.

FIG. 13 is a schematic diagram illustrating a configuration of the external device including the management device D1 and the support device D2. Referring to FIG. 13, the external device D1, D2 includes a controller 500, a transmitter 510, and a receiver 520. The controller 500 operates as a main control part that controls the operation of the entire management device D1 or the support device D2. Like the controller 30, the controller 500 is composed of a processing unit (i.e., processor) including a CPU and an internal memory. The CPU executes a program stored in the internal memory to implement various functions of the controller 500. The transmitter 510 transmits information to the outside of the management apparatus FS or the mobile terminal MS. The receiver 520 receives information transmitted to the management device D1 or the support device D2.

Figure 2:
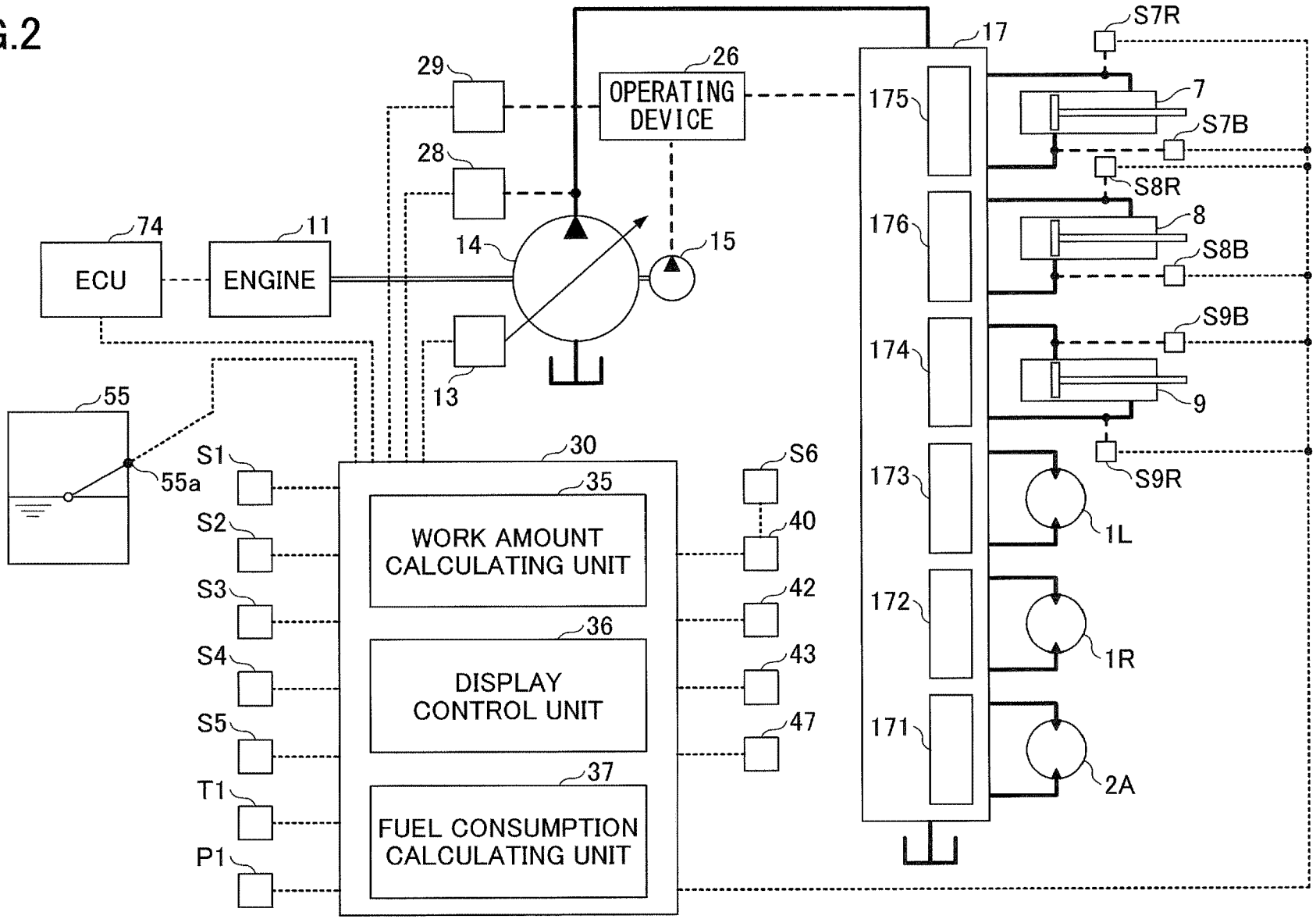
FIG. 2 is a block diagram showing an example of a configuration of a driving system of a shovel in FIG. 1.

FIG. 2 is a block diagram illustrating an example of a configuration of a driving system of a shovel 100, wherein a mechanical power system, a hydraulic oil line, a pilot line, and an electric control system are shown as double, solid, dashed, and dotted lines, respectively.

The drive system of the shovel 100 primarily includes an engine 11, a regulator 13, a main pump 14, a pilot pump 15, a control valve 17, an operating device 26, a discharge pressure sensor 28, an operating pressure sensor 29, a controller 30, a fuel tank 55, an engine control unit (ECU 74), and the like.

The engine 11 is the driving source of the shovel 100. In this embodiment, engine 11 is, for example, a diesel engine that operates to maintain a predetermined speed. The output shaft of the engine 11 is coupled to the respective input shafts of the main pump 14 and pilot pump 15.

The main pump 14 is configured to supply hydraulic oil to the control valve 17 via a hydraulic oil line. In this embodiment, the main pump 14 is a swash plate variable displacement hydraulic pump.

The regulator 13 is configured to control the discharge amount of the main pump 14. In this embodiment, the regulator 13 controls the discharge amount of the main pump 14 by adjusting a tilt angle of a swash plate of the main pump 14 in response to a control command from the controller 30. For example, the controller 30 receives an output from an operating pressure sensor 29 and the like, and outputs a control command to the regulator 13 as needed to change the discharge amount of the main pump 14.

The pilot pump 15 supplies hydraulic oil through the pilot line to various hydraulic control devices, including the operating device 26. In this embodiment, the pilot pump 15 is a fixed capacitance hydraulic pump. However, the pilot pump 15 may be omitted. In this case, the function performed by the pilot pump 15 may be implemented by the main pump 14. That is, the main pump 14 may have a function of supplying hydraulic oil to the control valve 17, as well as a function of supplying hydraulic oil to the operating device 26 after the supply pressure of the hydraulic oil is lowered by a squeeze or the like.

The control valve 17 is a hydraulic controller for controlling the hydraulic system at the shovel 100. In this embodiment, the control valve 17 includes control valves 171 to 176. The control valve 17 can selectively supply the hydraulic oil discharged from the main pump 14 to one or more hydraulic actuators through the control valves 171 to 176. The control valves 171 to 176 are configured to control the flow rate of hydraulic oil flowing from the main pump 14 to the hydraulic actuator and the flow rate of hydraulic oil flowing from the hydraulic actuator to the hydraulic oil tank. The hydraulic actuator includes a boom cylinder 7, an arm cylinder 8, a bucket cylinder 9, a left-side running hydraulic motor 1L, a right-side running hydraulic motor 1R, and a turning hydraulic motor 2A. The turning hydraulic motor 2A may be a swivel motor-generator as an electric actuator. In this case, the swivel motor-generator may receive power from an electrical storage unit or a motor-generator.

The operating device 26 is a device used by an operator for actuator operation. The actuator includes at least one of a hydraulic actuator and an electric actuator. In this embodiment, the operating device 26 supplies the hydraulic oil discharged from the pilot pump 15 via a pilot line to the pilot port of the corresponding control valve in the control valve 17. The pressure (pilot pressure) of the hydraulic oil supplied to each of the pilot ports is, in principle, a pressure depending on the direction and amount of operation of the operating device 26 corresponding to each of the hydraulic actuators. At least one of the operating devices 26 is configured to supply the hydraulic oil discharged from the pilot pump 15 to the pilot port of a corresponding control valve within the control valve 17 via a pilot line.

The discharge pressure sensor 28 is configured to detect the discharge pressure of the main pump 14. In this embodiment, the discharge pressure sensor 28 outputs the detected value to the controller 30.

The operating pressure sensor 29 is configured to detect the operator's operation content using the operating device 26. In this embodiment, the operating pressure sensor 29 detects the operating direction and the amount of operation of the operating device 26 corresponding to each of the actuators in the form of pressure and outputs the detected value to the controller 30. The operation content of the operating device 26 may be detected using other sensors other than the operating pressure sensor.

The fuel tank 55 is a container for containing the fuel. The remaining amount of fuel contained in the fuel tank 55 is detected by the fuel remaining amount sensor 55*a*. The fuel remaining amount sensor 55*a* outputs information about the remaining amount of fuel to the controller 30.

An ECU 74 is configured to control the engine 11. In this embodiment, the ECU 74 controls the amount of fuel injection, fuel injection timing, boost pressure, and the like in the engine 11. The ECU 74 also outputs information about the engine 11 to the controller 30.

Next, the functional elements of the controller 30 will be described. A work amount calculating unit 35 is configured to calculate the amount of work of the shovel 100. According to the present exemplary embodiment, the work amount calculating unit 35 calculates an amount of work based on the information acquired by the information acquiring device. The information acquired by the information acquiring device includes at least one of a boom angle, an arm angle, a bucket angle, an back and forth inclined angle, a right and left inclined angle, a turning angle velocity, a turning angle, a boom rod pressure, a boom bottom pressure, an arm rod pressure, an arm bottom pressure, a bucket rod pressure, a bucket bottom pressure, an image imaged by an imaging device S6, a discharge pressure of the main pump 14, and an operating pressure for each of the operating devices 26. The information acquiring device includes at least one of a boom angle sensor S1, an arm angle sensor S2, a bucket angle sensor S3, an airframe inclination sensor S4, a turning angular velocity sensor S5, an imaging device S6, a boom rod pressure sensor S7R, a boom bottom pressure sensor S7B, an arm rod pressure sensor S8R, an arm bottom pressure sensor S8B, a bucket rod pressure sensor S9R, a bucket bottom pressure sensor S9B, a discharge pressure sensor 28, and an operating pressure sensor 29.

Figure 3:
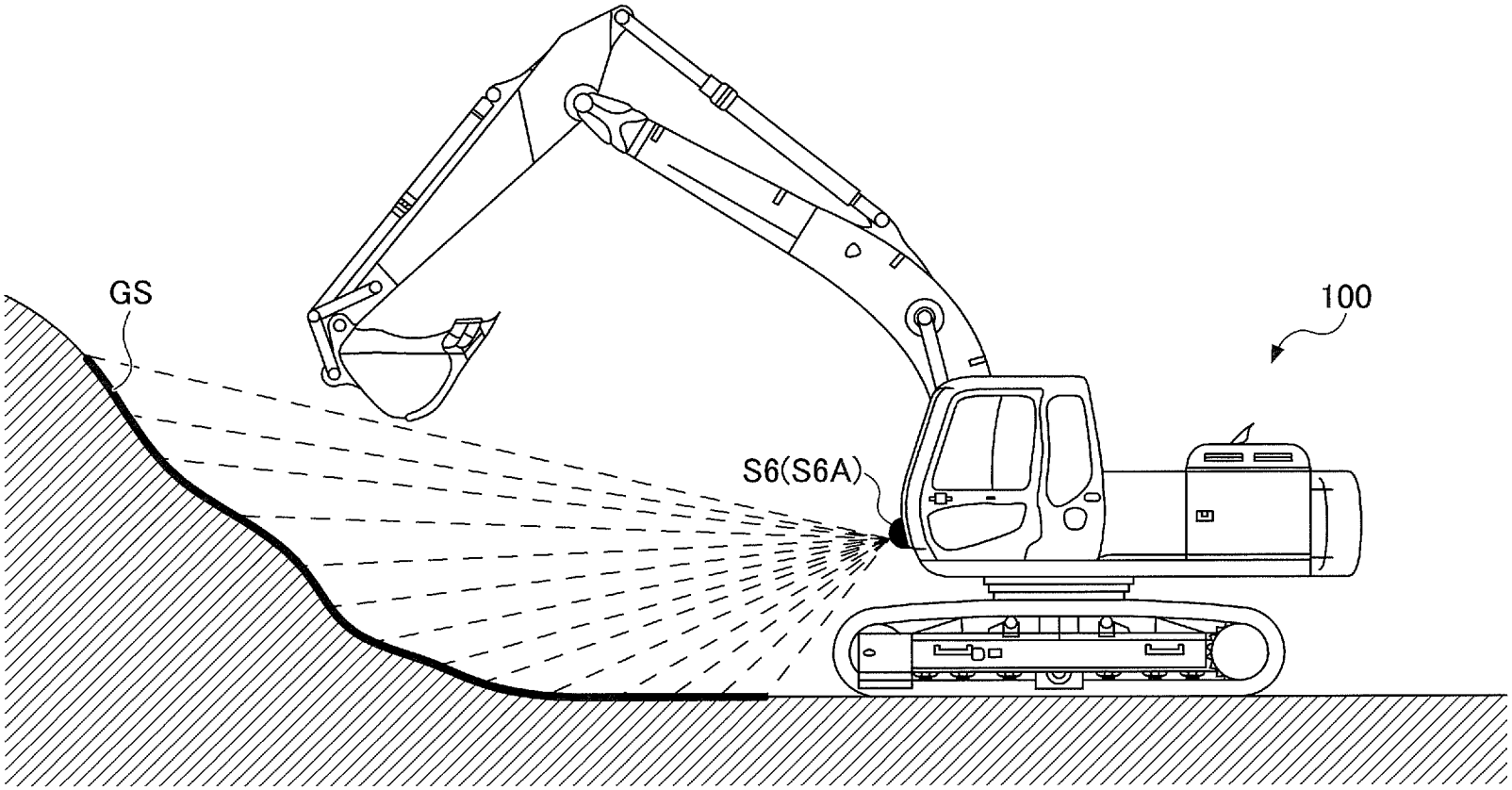
FIG. 3 is a side view of a shovel with an attached three-dimensional range image sensor.

For example, as shown in FIG. 3, the work amount calculating unit 35 calculates the amount of excavated materials such as soil and sand excavated by an excavating attachment as the amount of work based on the range image of the space in front of the shovel 100 imaged by the three-dimensional range image sensor S6A as the imaging device S6. The thick line GS of FIG. 3 represents a portion of the imaging range of the three-dimensional range image sensor S6A. The three-dimensional range image sensor S6A is a three-dimensional laser scanner that measures terrain with a laser, for example. The three-dimensional range image sensor S6A may be another spatial recognition device, such as a stereo camera. Specifically, the work amount calculating unit 35 calculates the volume (estimated value) of the excavated material in the excavation operation as the amount of work based on the range image taken when the excavation operation is started and the range image taken when the excavation operation is completed. In this way, the pre-excavation topography is compared with the post-excavation topography, and the amount of work per operation is calculated based on the change.

According to the present exemplary embodiment, the work amount calculating unit 35 is configured to determine the type of work content such as filling operation, loading operation, and excavation operation based on the information acquired by the information acquiring device. The filling operation is an operation to load soil in a predetermined position, and the loading operation is an operation to load earth and sand in a dump truck. In addition, the excavation operation is an operation to take in the excavated material in the bucket 6. For example, it is defined that the excavation operation starts when the bucket 6 that did not take in the excavated material contacted the ground, and it is defined that the excavation operation is completed when the bucket 6 that took in the excavated material separates from the ground. However, the conditions for determining that the excavation operation has started and the conditions for determining that the excavation operation has been completed can be set to any conditions. The same applies to other operations such as filling and unloading operations.

The work amount calculating unit 35 determines whether or not the excavation operation has started and whether or not the excavation operation has been completed based on the output of, for example, the operating pressure sensor 29 and the cylinder pressure sensor. The work amount calculating unit 35 may determine whether or not the excavation operation has started and whether or not the excavation operation has been completed based on the output of the attitude sensor for detecting the attitude of the excavation attachment. The attitude sensor includes, for example, a boom angle sensor S1, an arm angle sensor S2 and a bucket angle sensor S3. The attitude sensor may be a combination of stroke sensors.

With this configuration, the controller 30 can calculate the cumulative volume (estimated value) of the excavated material for each or more time excavations performed within a predetermined period of time as the amount of work for a predetermined period of time.

Figure 4A:
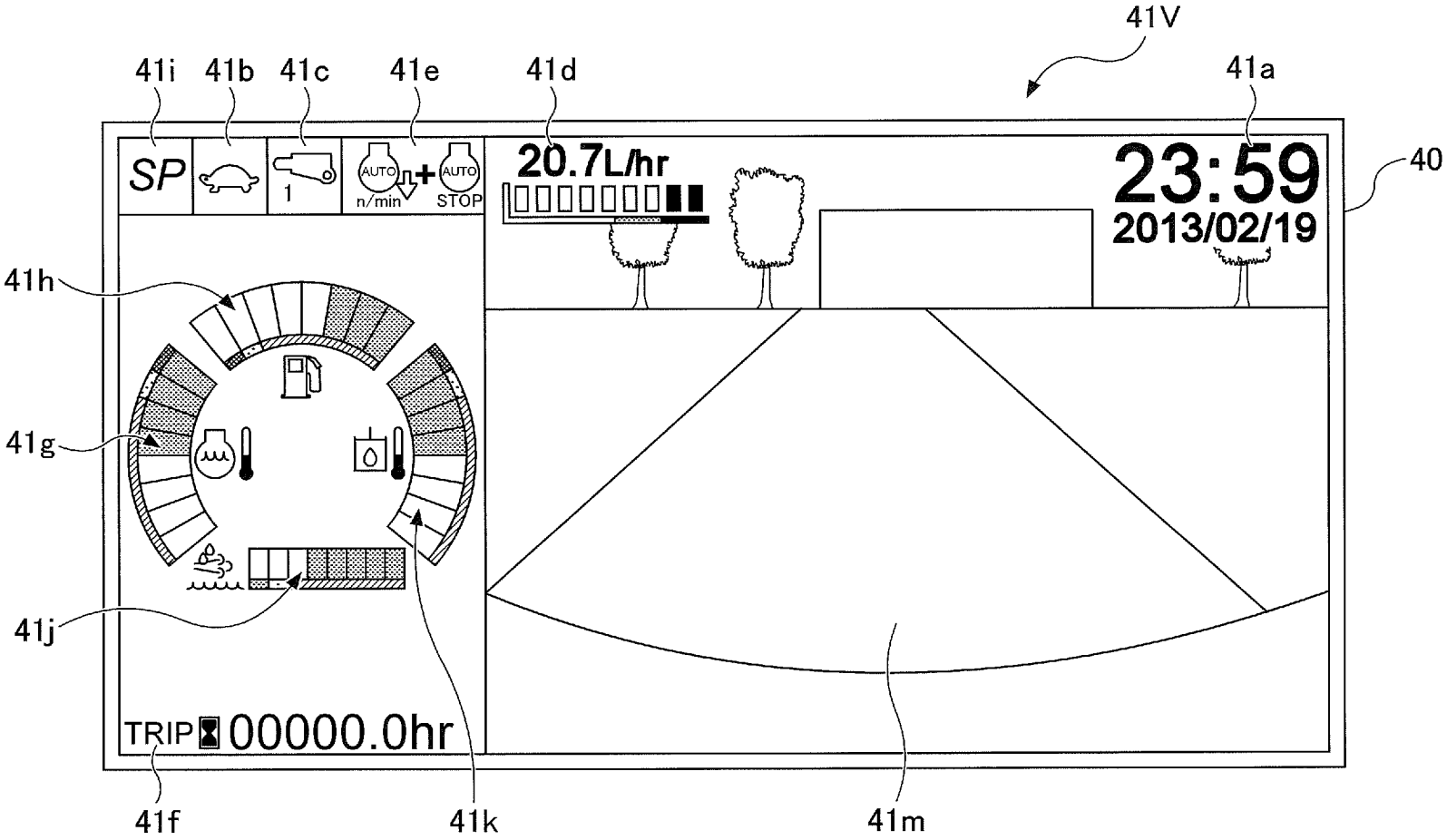
FIG. 4A shows an example of a main screen displayed on a display device.
Figure 4B:
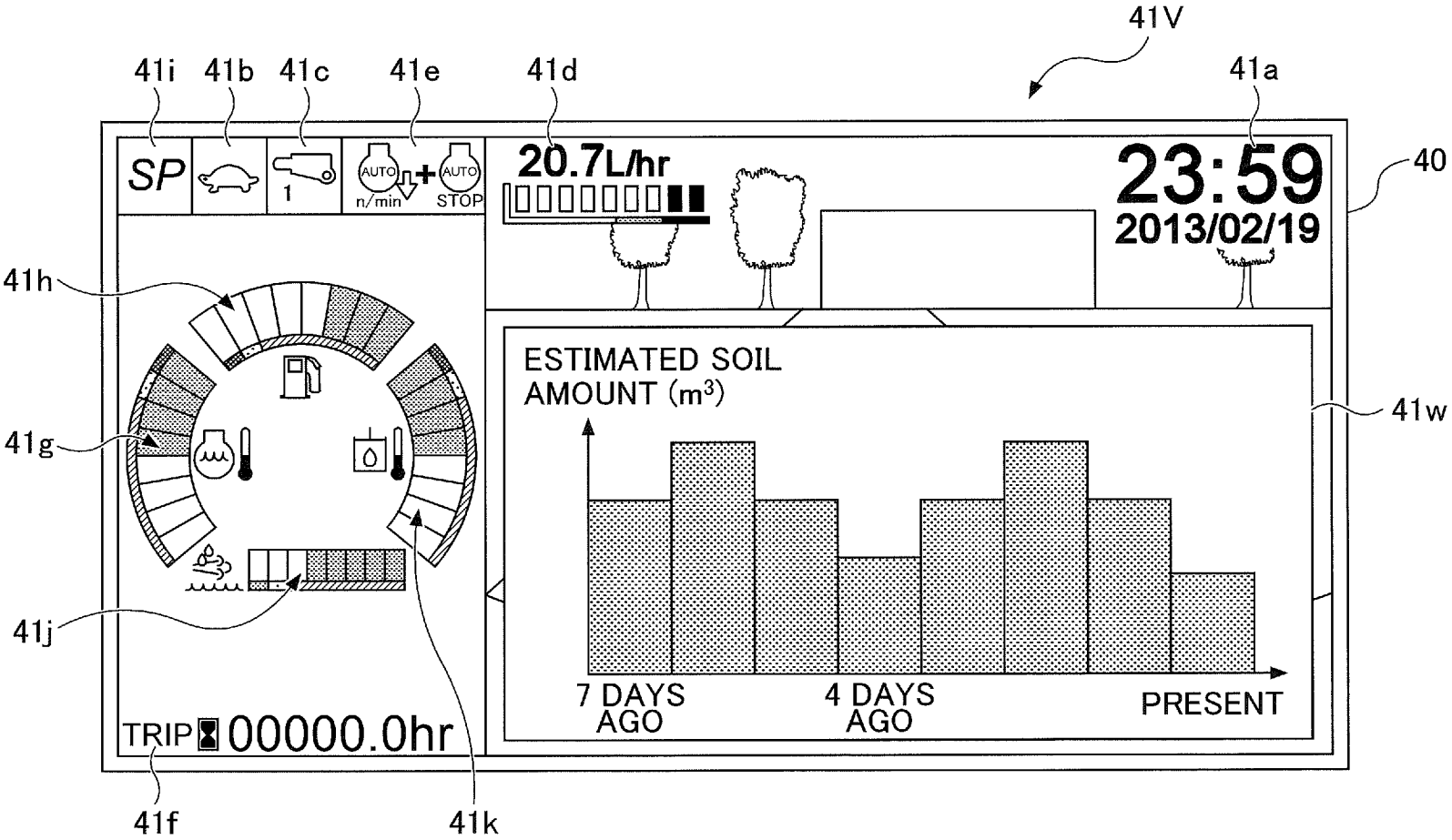
FIG. 4B shows another example of a main screen displayed on a display device.

The display control unit 36 is configured to control the content displayed on the display device 40. In this embodiment, the display control unit 36 displays various pieces of information on the display device 40 based on the information acquired by the information acquiring device. FIGS. 4A and 4B are examples of the main screen 41V displayed on the display device 40. The main screen 41V shown in FIG. 4A includes a date and time display region 41*a*, a traveling mode display region 41*b*, an attachment display region 41*c*, an average fuel economy display region 41*d*, an engine control state display region 41*e*, an engine operation time display region 41*f*, a cooling water temperature display region 41*g*, a fuel remaining amount display region 41*h*, a speed mode display region 41*i*, a urea water remaining amount display region 41*j*, an operating oil temperature display region 41*k*, and a camera image display region 41*m*. The traveling mode display region 41*b*, the attachment display region 41*c*, the engine control state display region 41*e*, and the rotating speed mode display region 41*i* are examples of the setting state display region for displaying the setting state of the shovel 100. The average fuel economy display region 41*d*, the engine operation time display region 41*f*, the cooling water temperature display region 41*g*, the fuel remaining amount display region 41*h*, the urea water remaining amount display region 41*j*, and the operating oil temperature display region 41*k* are examples of the operating state display region for displaying the operating state of the shovel 100.

The date and time display region 41*a* is a region for displaying the current date and time. The traveling mode display region 41*b* is a region for displaying a shape representing the current traveling mode. The attachment display region 41*c* is a region for displaying a shape representing an attachment currently mounted. The average fuel economy display region 41*d* is a region that displays the current average fuel economy. The average fuel economy is, for example, fuel consumption during a predetermined time period. The engine control state display region 41*e* is a region for displaying a graphic representing the control state of the engine 11. The cooling water temperature display region 41*g* indicates the temperature of the current engine cooling water. The fuel remaining amount display region

41*h* is the region indicating the remaining fuel amount stored in the fuel tank 55. The rotating speed mode display region 41*i* is a region for displaying the current rotating speed mode. The urea water remaining amount display region 41*j* is a region indicating the remaining amount of urea water stored in the urea water tank. The hydraulic oil temperature display region 41*k* is a region for indicating the temperature condition of the hydraulic oil in the hydraulic oil tank. The camera image display region 41*m* is a region where the camera image is displayed.

The information acquiring device includes a device for acquiring information necessary for displaying the main screen 41V, such as a cooling water temperature sensor and a fuel remaining amount sensor.

FIG. 4B shows a main screen 41V in which a work amount display screen 41*w* is superimposed on a camera image display region 41*m*. In this example, the display control unit 36 displays information concerning the amount of work in the work amount display screen 41*w* based on the amount of work calculated by the work amount calculating unit 35. The work amount display screen 41*w* may be displayed by being superimposed on other portions of the main screen 41V or may be displayed in full-screen.

The display control unit 36 displays the work amount display screen 41*w* when a predetermined button, for example, one of the input devices 42, is operated. The predetermined button may be a hardware button located around the display device 40 or may be a software button displayed on the display device 40 including a touch panel. The display control unit 36 may automatically display the work amount display screen 41*w* when a predetermined condition is satisfied.

The work amount display screen 41*w* shows the daily changes in amount of work as a bar graph. The change in amount of work may be displayed on an hourly or weekly basis, or on a timed basis. The vertical axis of the bar graph corresponds, for example, to the estimated soil content, which is an example of amount of work. In the example of FIG. 4B, the estimated soil amount is an estimate of the volume of soil as excavated material, and the unit thereof is [$m^3$] (cubic meters).

With this configuration, the controller 30 can present a transition of amount of work to an operator of the excavator 100 in a manner easy to understand.

The fuel consumption calculating unit 37 is configured to calculate the fuel consumption. In this embodiment, the fuel consumption calculating unit 37 calculates the fuel consumption based on the output of the fuel remaining amount sensor 55*a*. For example, the fuel consumption calculating unit 37 may calculate the fuel consumption every predetermined period of time.

Figure 5:
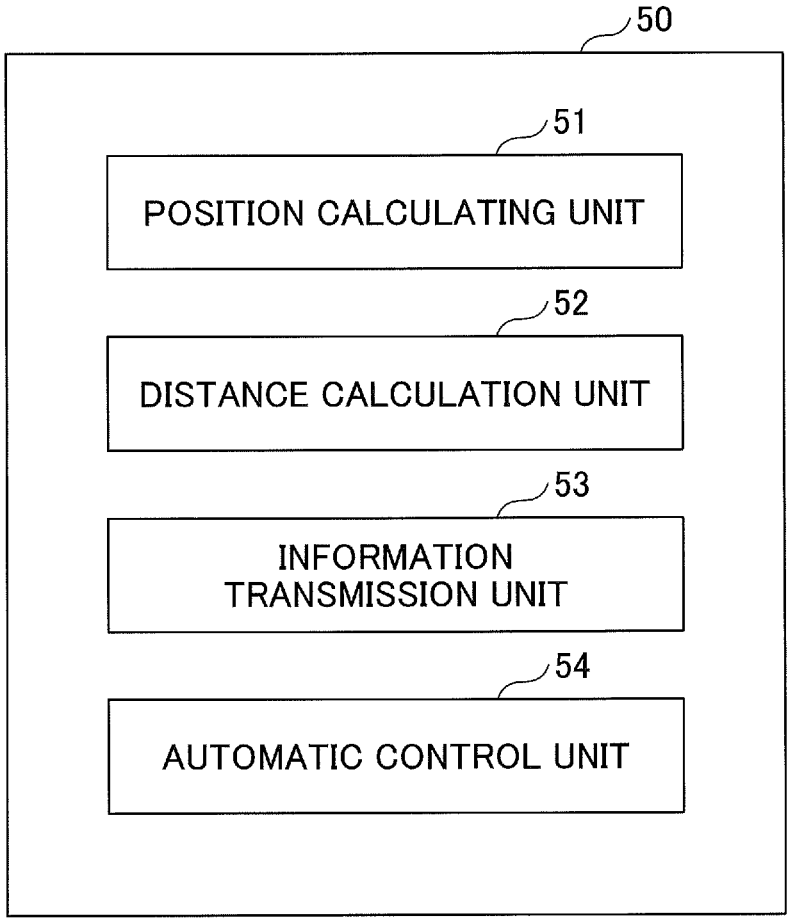
FIG. 5 is a diagram illustrating an example of a configuration of a machine guidance unit.

Next, with reference to FIG. 5, a case where the controller 30 includes a machine guidance unit 50 will be described. In calculating the amount of work, it is possible to use the function of the machine guidance unit 50 to calculate the position of the work site (for example, the toe position of the bucket 6). However, the machine guidance function and the machine control function are not required for calculating the amount of work.

The machine guidance unit 50 is configured to perform, for example, a machine guidance function. In this embodiment, the machine guidance portion 50 is configured to communicate, for example, the working information such as the distance between the target construction surface and the working portion of the attachment to the operator. Data relating to the target construction plane may be stored in advance, for example, in the storage device 47. The data for the target construction plane is represented, for example, in the frame of reference. The frame of reference is, for example, a world geodetic system. The world geodetic system is a three-dimensional orthogonal XYZ coordinate system with its origin at the center of earth's gravity, its X-axis in the direction of the intersection of the Greenwich meridian and equator, its Y-axis in the direction of 90 degrees east longitude, and its Z-axis in the direction of the Arctic. The operator may designate any point of the construction site as the reference point and set the target construction surface according to the position relative to the reference point. The working area of the attachment is, for example, the toe of the bucket 6 or the back of the bucket 6. The machine guidance unit 50 guides the operation of the shovel 100 by communicating work information to an operator through at least one of the display device 40 and the sound output device 43.

The machine guidance unit 50 may perform a machine control function that automatically assists an operator in manually operating the shovel 100. For example, the machine guidance unit 50 may automatically operate at least one of the boom 4, arm 5, and bucket 6 so that the target construction surface coincides with the distal end position of the bucket 6 when the operator is manually operating the excavation.

In this embodiment, the machine guidance portion 50 is incorporated into the controller 30, but may be a controller provided separately from the controller 30. In this case, the machine guidance unit 50 is constituted of a computer including, for example, a CPU and an internal memory, similar to the controller 30. The various functions of the machine guidance unit 50 are implemented by causing the CPU to executing a program stored in the internal memory. The machine guidance unit 50 and the controller 30 are connected to each other in a communication network such as a CAN.

Specifically, the machine guidance unit 50 acquires information from the boom angle sensor S1, the arm angle sensor S2, the bucket angle sensor S3, the airframe inclination sensor S4, the turning angular velocity sensor S5, the imaging device S6, the positioning device P1, the communication device T1, and the input device 42. The machine guidance unit 50 calculates the distance between the bucket 6 and the target construction surface based on, for example, the acquired information and transmits the magnitude of the distance between the bucket 6 and the target construction surface to the operator of the shovel 100 by a sound and an image display.

Therefore, the machine guidance unit 50 includes a position calculating unit 51, a distance calculating unit 52, an information transmission unit 53, and an automatic control unit 54.

The position calculating unit 51 is configured to calculate the position of the positioning target. In this embodiment, the position calculating unit 51 calculates the coordinate point in the frame of reference of the working portion of the attachment. Specifically, the position calculating unit 51 calculates the coordinate point of the toe of the bucket 6 from the rotation angles of the boom 4, the arm 5, and the bucket 6, respectively.

The distance calculating unit 52 is configured to calculate the distance between the two positioning targets. In this embodiment, the distance calculating unit 52 calculates the vertical distance between the toe of the bucket 6 and the target construction surface.

The information transmission unit 53 is configured to communicate various information to an operator of the excavator 100. According to the present exemplary embodiment, the information transmission unit 53 communicates the magnitudes of various distances calculated by the distance calculating unit 52 to an operator of the excavator 100. Specifically, the information transmission unit 53 communicates the magnitudes of the vertical distance between the toe of the bucket 6 and the target construction surface to an operator of the shovel 100 using at least one of the visual information and the auditory information.

For example, the information transmission unit 53 may communicate the magnitude of the vertical distance between the toe of the bucket 6 and the target construction surface to the operator using an intermittent sound generated by the sound output device 43. In this case, the information transmission unit 53 may shorten the interval of intermittent sounds as the vertical distance decreases. However, a continuous sound may be used by the information transmission unit 53, and a difference in the magnitude of vertical distance may be expressed by changing at least one of the pitch and dynamics of the sound. The information transmission unit 53 may issue an alarm when the toe of the bucket 6 is lower than the target construction surface. An alarm is, for example, a continuous sound that is significantly greater than an intermittent sound.

The information transmission unit 53 may display the vertical distance between the toe of the bucket 6 and the target construction surface as work information on the display device 40. For example, the display device 40 displays the operation information received from the information transmission unit 53 on the screen together with the image data received from the imaging device S6. The information transmission unit 53 may communicate the magnitude of the vertical distance to the operator using, for example, an image of an analog meter or an image of a bar graph indicator.

The automatic control unit 54 automatically assists the operator manually operating the shovel 100 by automatically operating the actuator. For example, the automatic control unit 54 may automatically expand and contract at least one of the boom cylinder 7, the arm cylinder 8 and the bucket cylinder 9 so that the target construction surface and the position of the toe of the bucket 6 coincide with each other when the operator manually closes the arm. In this case, the operator can close the arm 5 while aligning the toe of the bucket 6 with the target construction surface, for example, by simply operating the arm operation lever in the closed direction. The automatic control may be configured to be performed when a predetermined switch, one of the input devices 42, is pressed. A predetermined switch is, for example, a machine control switch (hereinafter referred to as "MC switch"), which may be disposed as a knob switch at the distal end of the operating device 26.

The automatic control unit 54 may automatically rotate the turning hydraulic motor 2A to cause the upper turning body 3 to face the target construction surface when a predetermined switch, such as an MC switch, is pressed. In this case, the operator can cause the upper turning body 3 to face the target construction surface by simply pressing the predetermined switch. Alternatively, the operator may simply press a predetermined switch to bring the upper turning body 3 opposite to the target construction surface and initiate the machine control function.

In this embodiment, the automatic control portion 54 can automatically operate each actuator by individually and automatically adjusting the pilot pressure acting on the control valves corresponding to each actuator.

The work amount calculating unit 35 of the controller 30 may calculate the amount of work of the shovel 100 using the function of the machine guidance unit 50. Specifically, the work amount calculating unit 35 may calculate the work amount based on the time transition of the position of the toe of the bucket 6 calculated by the position calculating unit 51.

Figure 6:
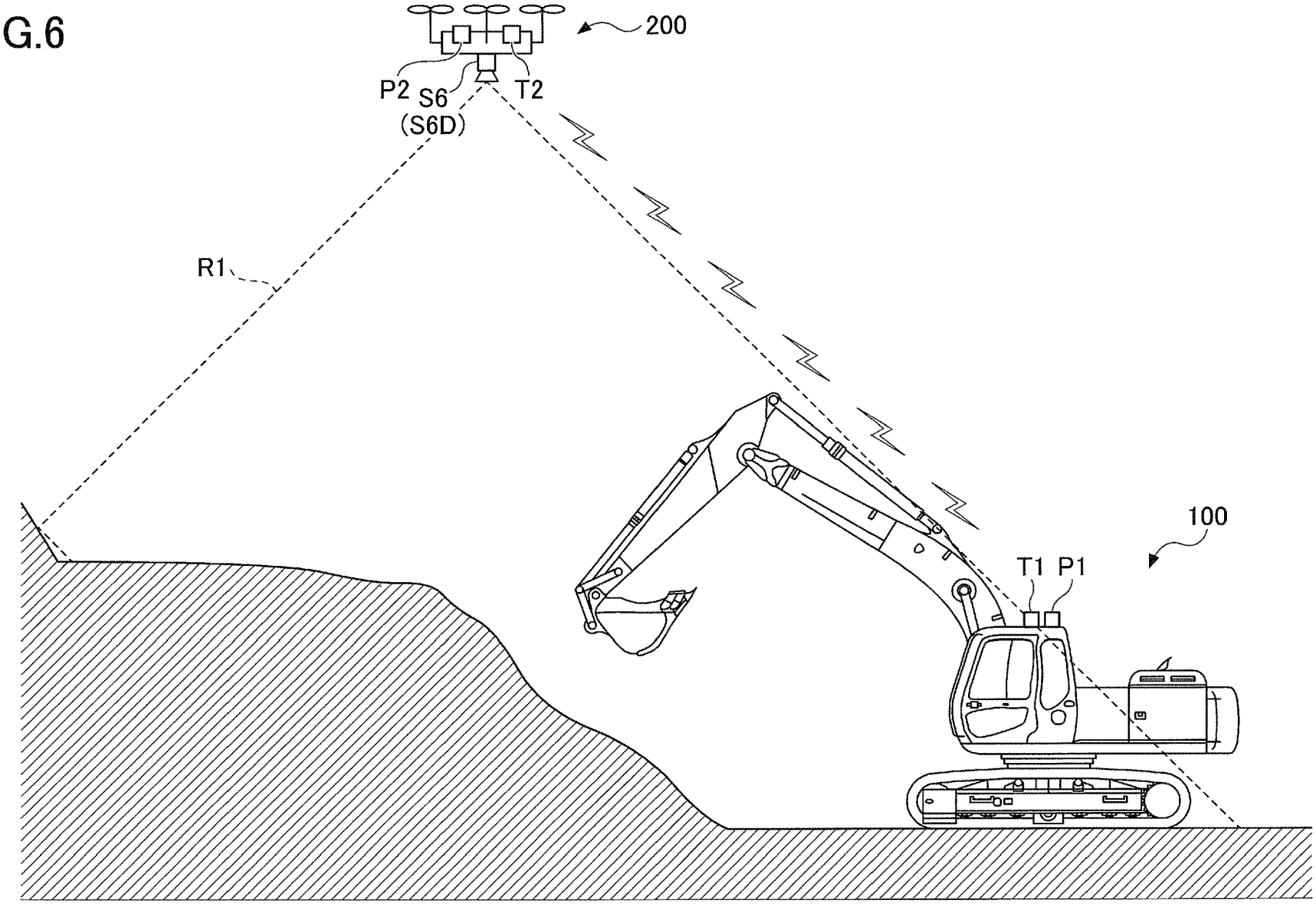
FIG. 6 is a side view of a shovel that receives a range image from a flight object.

For example, as shown in FIG. 6, the work amount calculating unit 35 derives the terrain before the excavation operation starts based on the range image of the space in front of the shovel 100 generated by the stereo camera S6D as the imaging device S6 mounted on the flight object 200. The dashed line R1 in FIG. 6 shows the imaging range of the stereo camera S6D. The imaging device S6 may be another spatial recognition device, such as a three-dimensional range image sensor. The flight object 200 may be, for example, a multicopter or airship, and includes a positioning device P2 to locate and orient the range image. Further, the flight object 200 includes a communication device T2 that enables communication with the shovel 100. The work amount calculating unit 35 receives the range image generated by the stereo camera S6D of the flight object 200 through the communication device T1 and derives the terrain before starting the excavation operation based on the range image. The work amount calculating unit 35 may be configured to receive an image captured by the stereo camera S6D of the flight object 200 through the communication device T1, to generate a range image from the image, and to derive a terrain form before the excavation operation starts based on the range image.

Figure 7:
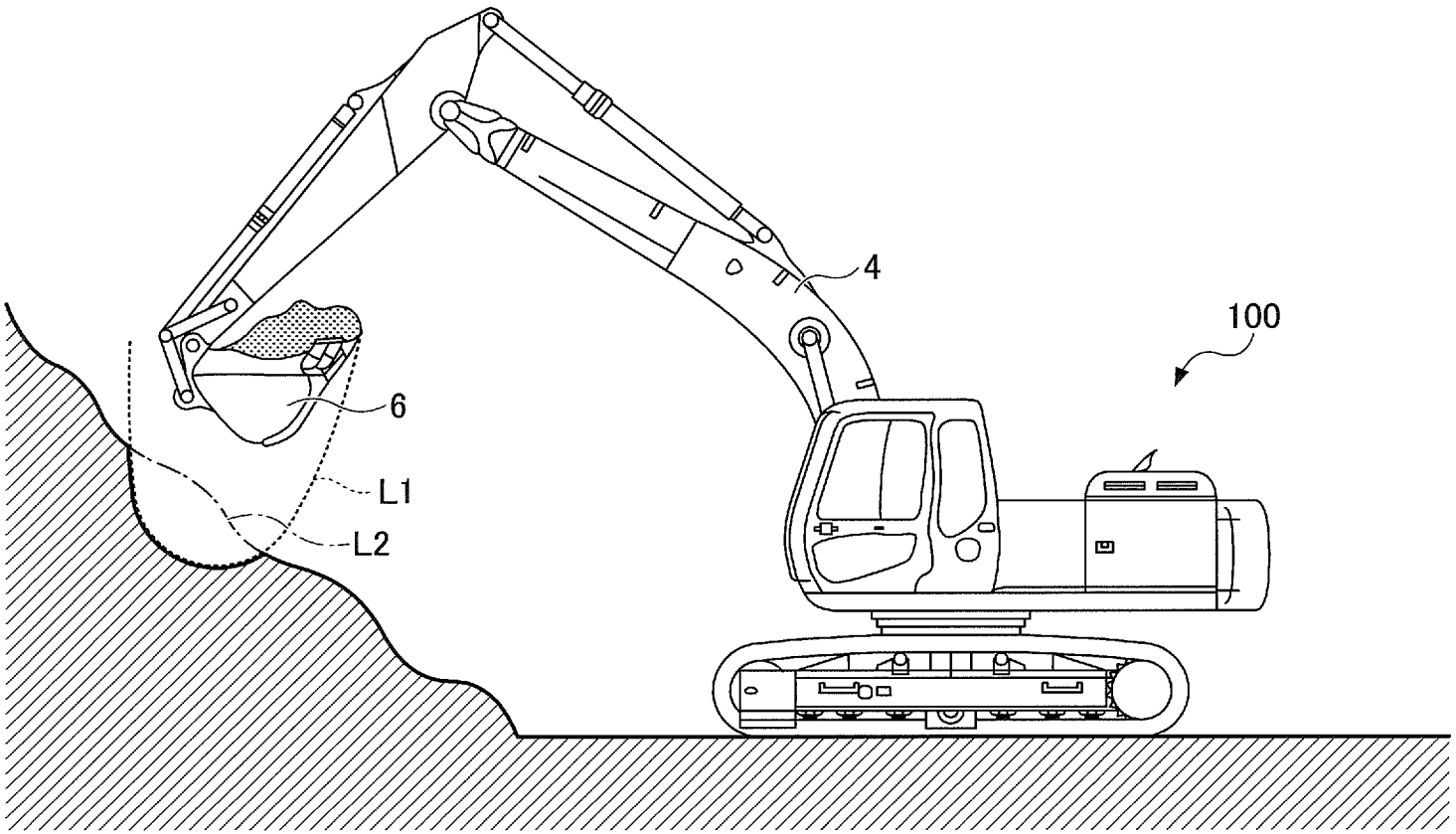
FIG. 7 is a side view of a shovel leading to a toe trajectory of a bucket.

Thereafter, the work amount calculating unit 35 calculates the amount of the excavated material such as soil and sand excavated by the excavation attachment as the work amount based on the locus of the position of the toe of the bucket 6 calculated by the position calculating unit 51 (dashed line L1 in FIG. 7) and the terrain before the excavation operation starts (dotted line L2 in FIG. 7). Determination of whether or not the ground surface contacts the working area is based on the change in pressure of the hydraulic oil in, for example, a boom cylinder 7, an arm cylinder 8, or a bucket cylinder 9. The determination of whether or not the ground has touched the work site may be based on a comparison of the position of the work site at the time of the previous contact with the position of the current work site. Specifically, the work amount calculating unit 35 calculates the volume (estimated value) of the excavated material in the excavation operation as the work amount based on the topography when the excavation operation starts, and the trajectory of the toe of the bucket 6 during the excavation operation.

With this configuration, the controller 30 can calculate the cumulative volume (estimated) of the excavated material for each or more excavations performed within a predetermined period of time as the amount of work for a predetermined period of time.

In the example of FIG. 6, the controller 30 acquires landform information from the flight object 200 before work by the shovel 100 begins. However, the controller 30 may acquire information regarding the topographic change from the flight object 200 at predetermined time intervals to understand the amount of work every predetermined period of time.

Figure 8:
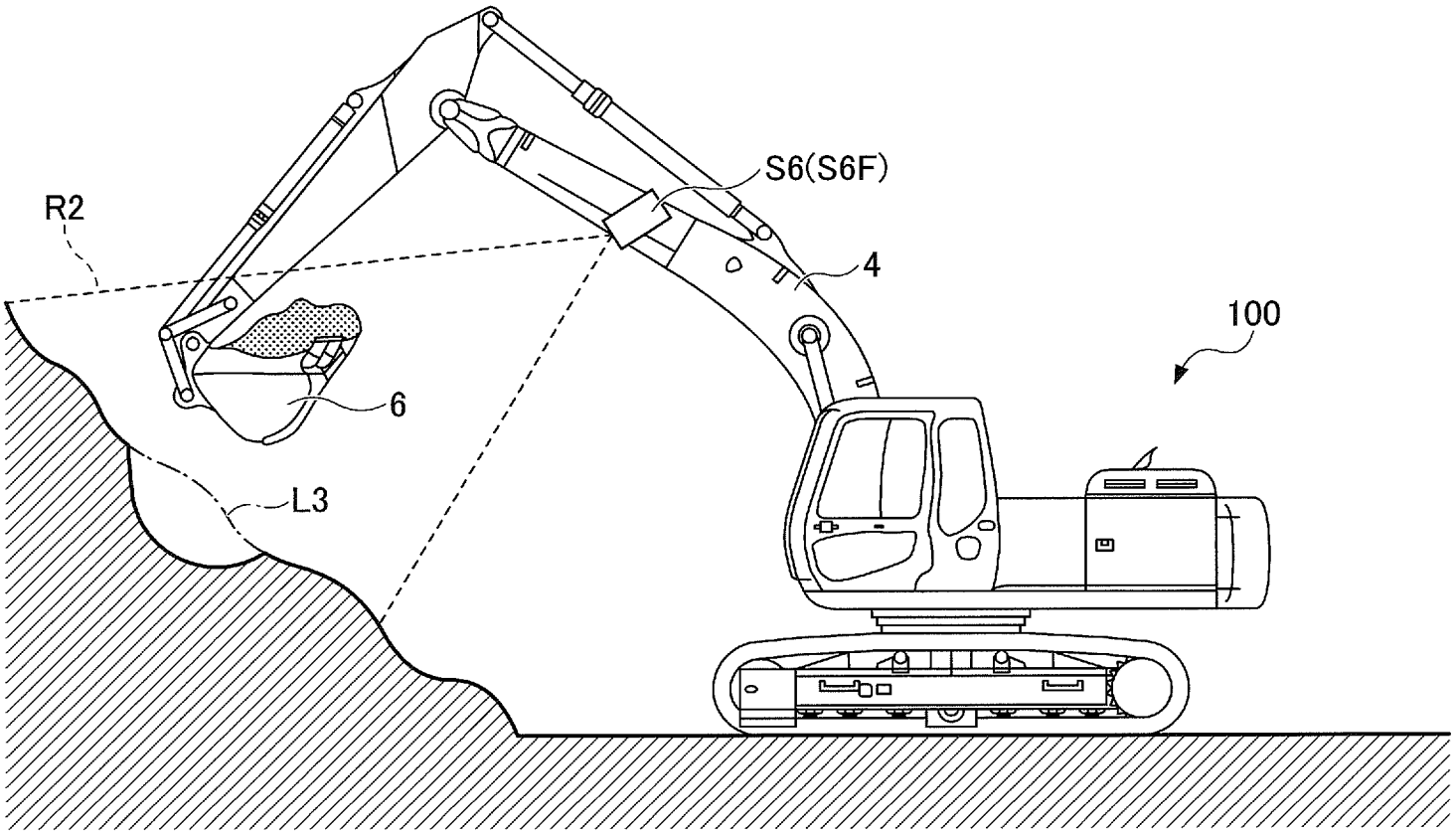
FIG. 8 is a side view of a shovel with a stereo camera.

As shown in FIG. 8, the work amount calculating unit 35 may calculate the work amount of the shovel 100 based on an image of the space in front of the shovel 100 captured by the front camera S6F. A dashed line R2 in FIG. 8 represents the imaging range of the front camera S6F, and a dotted line L3 represents the terrain before the excavation operation starts. In this case, the front camera S6F may be a monocular camera, a stereo camera, or other spatial recognition devices, such as a three-dimensional range image sensor. In the example of FIG. 8, the work amount calculating unit 35 calculates the volume (estimated value) of the excavated material in the bucket 6 as the work amount based on the image of the bucket 6 captured by the front camera S6F.

Specifically, the work amount calculating unit 35 recognizes the image of the excavated material in the bucket 6 by performing various image processing on the image of the bucket 6 captured by the front camera S6F when the bucket 6 which has taken the excavated material is lifted up in the air. Then, the volume (estimated value) of the excavated material in the bucket 6 is derived based on the size of the image of the excavated material. The work amount calculating unit 35 may additionally use the output of other information acquiring devices such as the attitude sensor to derive the volume (estimated value) of the excavated material in the bucket 6.

With this configuration, the controller 30 can calculate the cumulative value of the volume (estimated value) of the excavated material for each or more excavations performed within a predetermined period of time as the amount of work for a predetermined period of time.

The excavation work with the shovel 100 includes deep excavation work as well as normal excavation work. For this reason, the controller 30 may acquire information on the landform before excavation and the landform after excavation by other spatial recognition devices, such as the stereo camera S6D mounted on the flight object 200 (see FIG. 6), instead of acquiring information on the excavated material in the bucket 6 by the front camera S6F mounted on the boom 4 as shown in FIG. 8. In this case, the controller 30 may estimate the amount of work based on information about the change in the pre-excavation and post-excavation terrain due to deep excavation operations.

The work amount calculating unit 35 may calculate the amount of work of the shovel 100 based on the output of the attitude sensor and the cylinder pressure sensor. For example, the work amount calculating unit 35 may calculate the amount of work as the weight (estimated value) of the excavated material in a single excavation operation based on the attitude of the excavation attachment and the boom bottom pressure when the bucket 6 containing the excavated material is lifted up in the air.

With the configuration, the controller 30 can calculate the cumulative weight (estimate) of the excavated material for each or more excavations performed within a predetermined time period as the amount of work for a predetermined time period.

In this case, the display control unit 36 may display information on the weight (estimated value) of the excavated material at a predetermined time on the display unit 40 based on the weight (estimated value) of the excavated material calculated by the work amount calculation unit 35.

Figure 9:
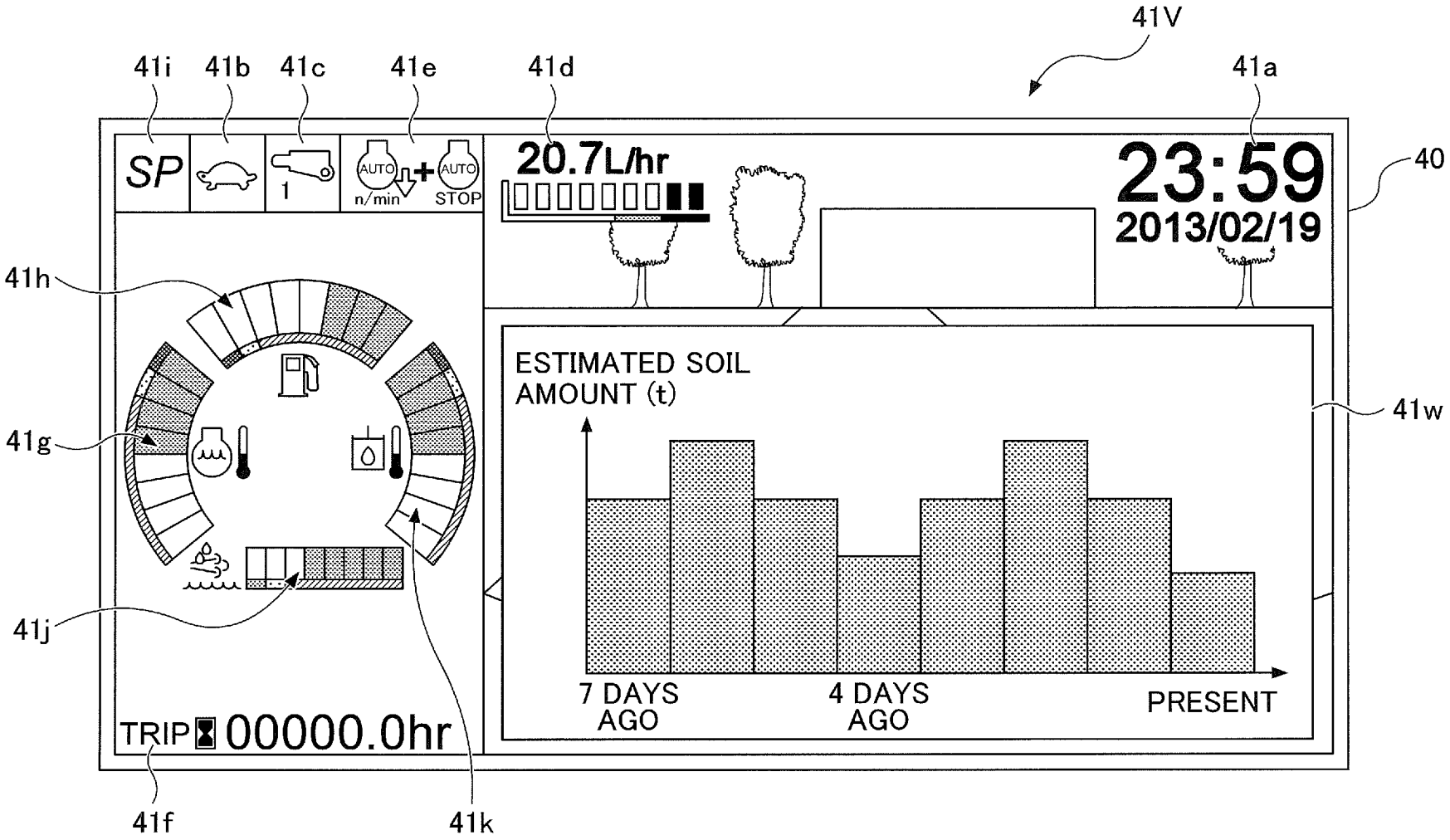
FIG. 9 is another example of a main screen displayed on a display device.

FIG. 9 is another example of the main screen 41V displayed in the display device 40 and corresponds to FIG. 4B. The work amount display screen 41*w* in FIG. 9 differs from the work amount display screen 41*w* in FIG. 4B in that the changes in the weight (estimated value) of the excavated material are displayed in a bar graph. The vertical axis of the bar graph in FIG. 9 corresponds to the estimated soil weight. In the example of FIG. 9, the estimated soil weight is an estimate of the weight of soil as excavated material in units of [t] (tons).

With the configuration, the controller 30 can provide an operator of the excavator 100 with an understandable transition in the weight of earth and sand as an amount of work. This indication of the weight of the earth and sand over time is useful in loading the excavated material into a dump truck, for example. This is because the operator of the shovel 100 can easily see the total weight of earth and sand loaded into the dump truck. In this case, the weight of the earth and sand may be indicated for each dump truck.

Next, another configuration example of the display screen 41*w* displayed on the display device 40 will be described with reference to FIGS. 10A to 10F. FIGS. 10A to 10F are diagrams illustrating another configuration example of the work amount display screen 41*w*.

Figure 10A:
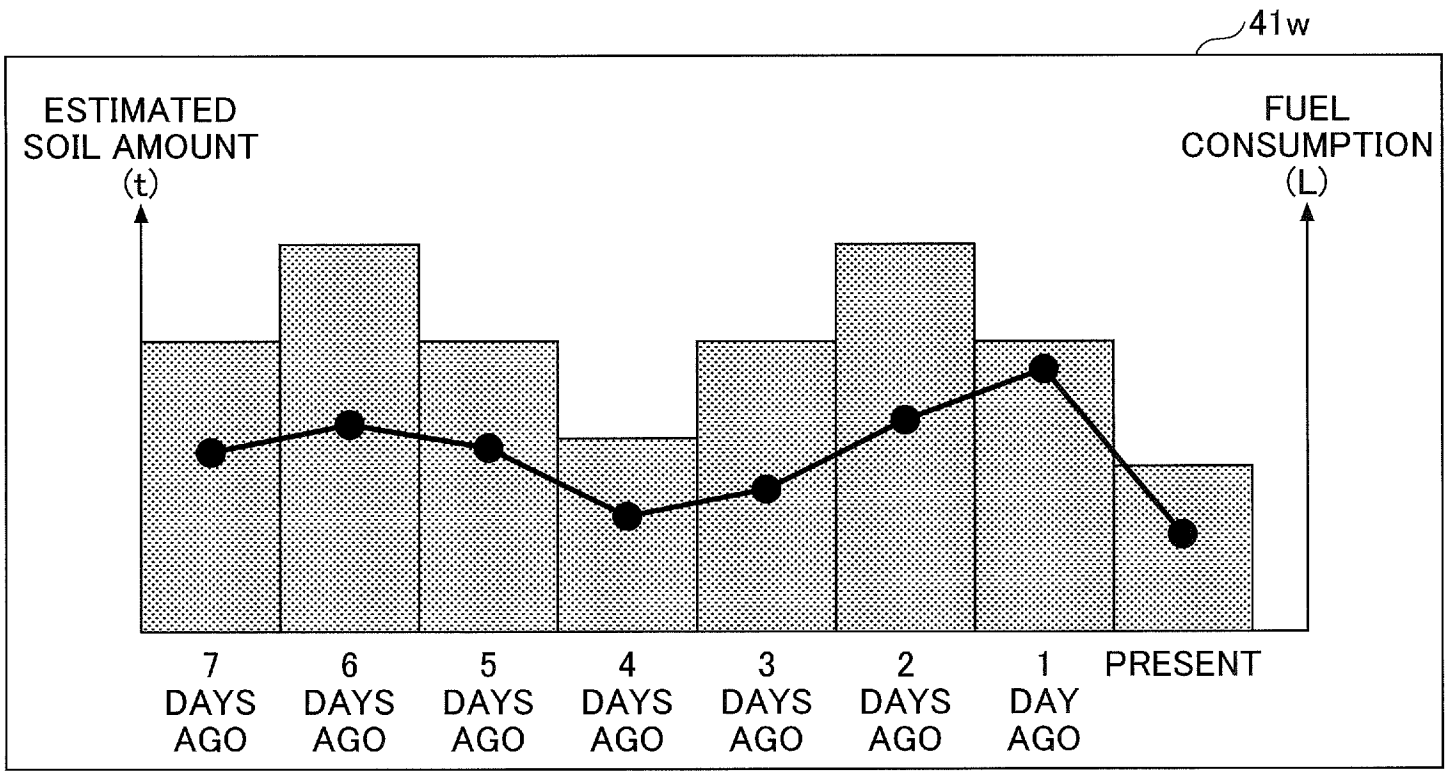
FIG. 10A shows an example of a work amount displaying screen.

In FIG. 10A, the work amount display screen 41*w* displays the daily transition of estimated soil amount as a bar graph and the daily transition of fuel consumption as a line graph. In this example, the estimated amount of soil is an estimate of the weight of soil [t] as excavated material. The unit of fuel consumption is [L] (liters).

Figure 10B:
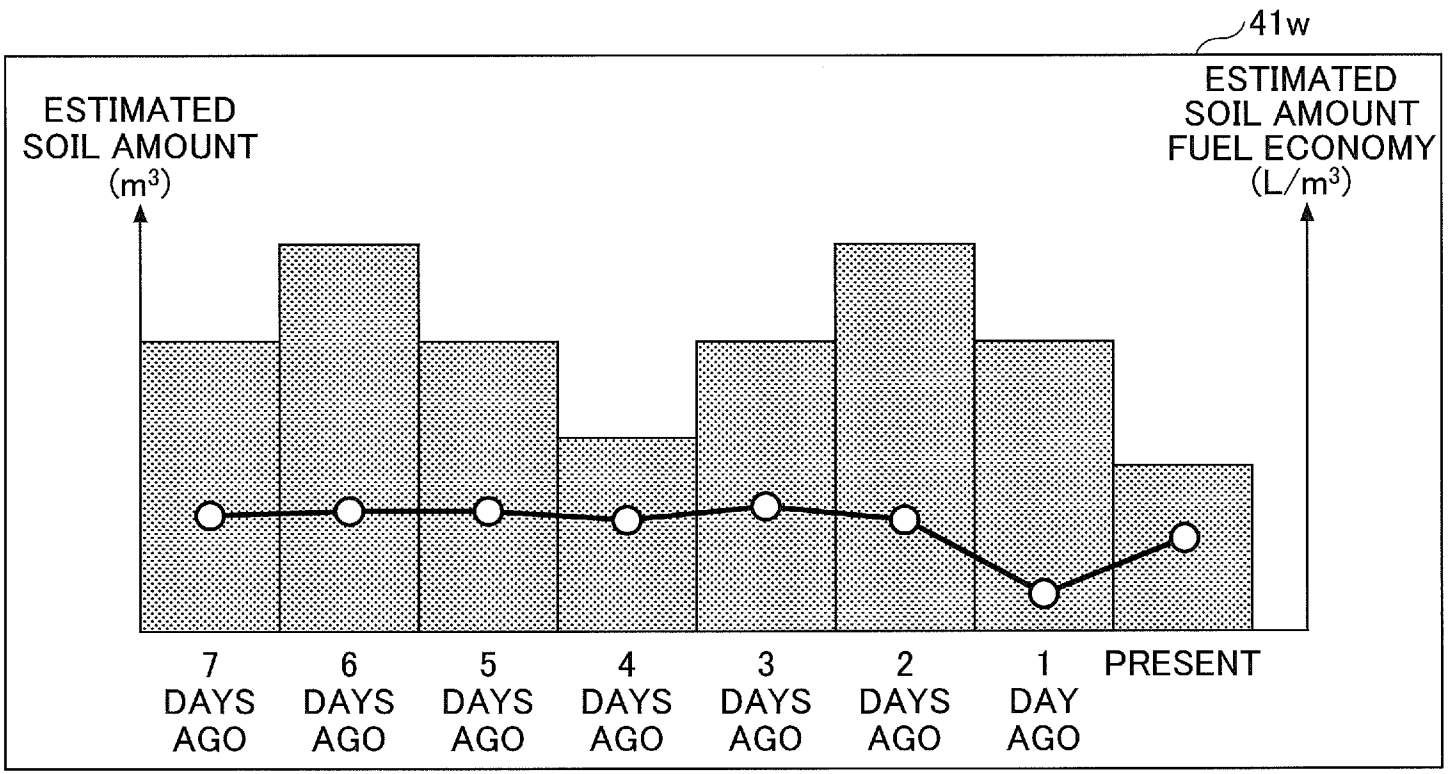
FIG. 10B shows another example of a work amount displaying screen.

In FIG. 10B, the work amount display screen 41*w* displays the daily transition of estimated soil amount as a bar graph and the daily transition of estimated soil amount fuel economy as a line graph. In this example, the estimated soil volume is an estimate of the volume of earth and sand as excavated material [$m^3$], and the estimated soil amount fuel consumption is the fuel consumption per unit estimated soil volume. Specifically, the estimated soil fuel economy is the daily fuel consumption divided by the estimated daily soil consumption in units of [$L/m^3$]. In this case, the lower the calculated value, the better the estimated soil fuel economy. However, the estimated amount of soil may be an estimate of the weight of soil [t] as an excavated material. In this case, the unit of estimated soil fuel economy is [L/t]. Estimated soil fuel economy may also be expressed in the inverse number. For example, the estimated soil amount fuel economy may be expressed as the estimated daily soil weight divided by daily fuel consumption. In this case, the higher the calculated value, the better the estimated soil amount fuel economy.

Figure 10C:
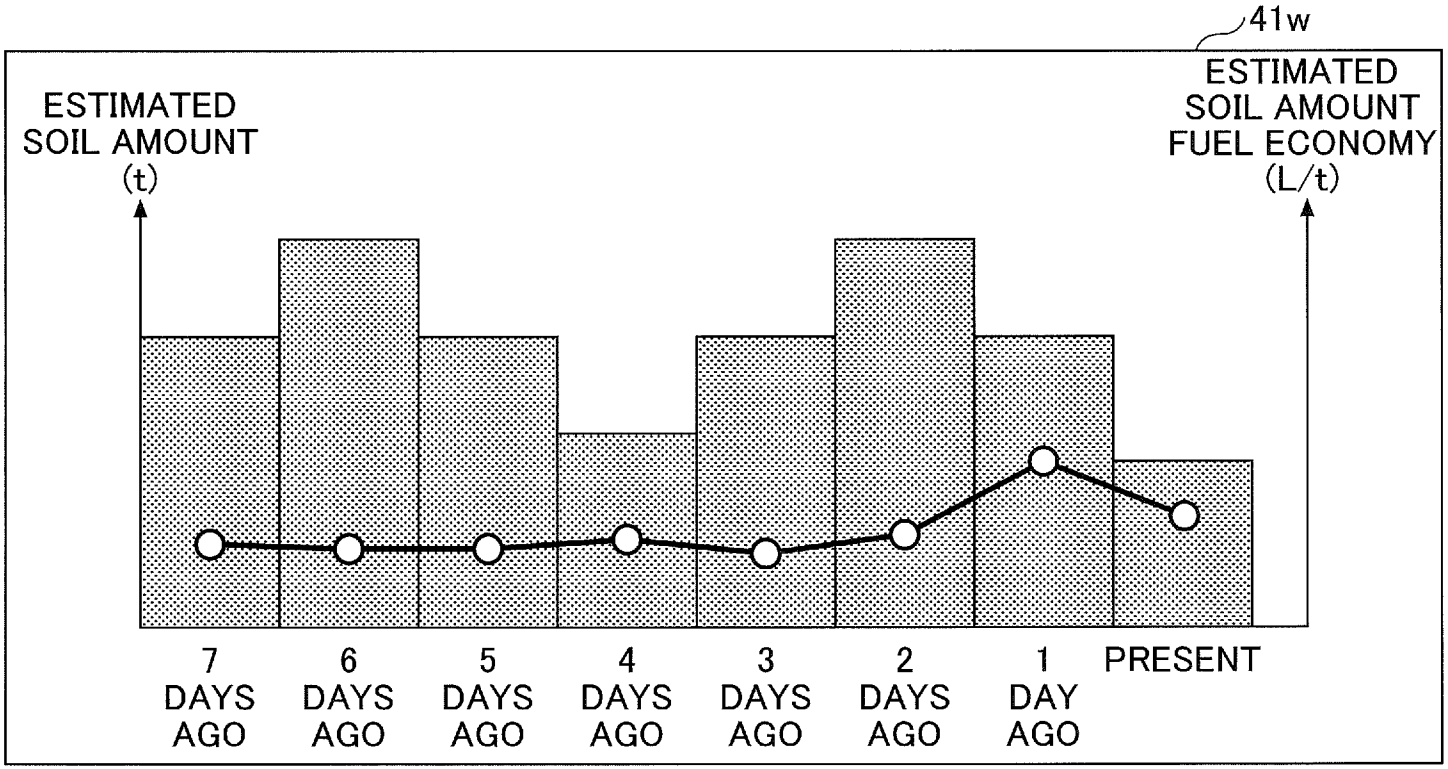
FIG. 10C shows further another example of a work amount displaying screen.

In FIG. 10C, the work amount display screen 41*w* displays the daily transition of estimated soil amount as a bar graph and the daily transition of estimated soil amount fuel economy as a line graph. In this example, the estimated soil amount is an estimate of the weight of soil [t] as excavated material, and the estimated soil amount fuel consumption is the fuel consumption per unit estimated soil weight. Specifically, the estimated soil fuel economy is the daily fuel consumption divided by the estimated daily soil consumption in units of [L/t]. Estimated soil fuel economy may be also expressed in the inverse number. For example, the estimated soil weight fuel economy may be expressed as the estimated daily soil weight divided by daily fuel consumption. In this case, the higher the calculated value, the better the estimated soil fuel economy.

Figure 10D:
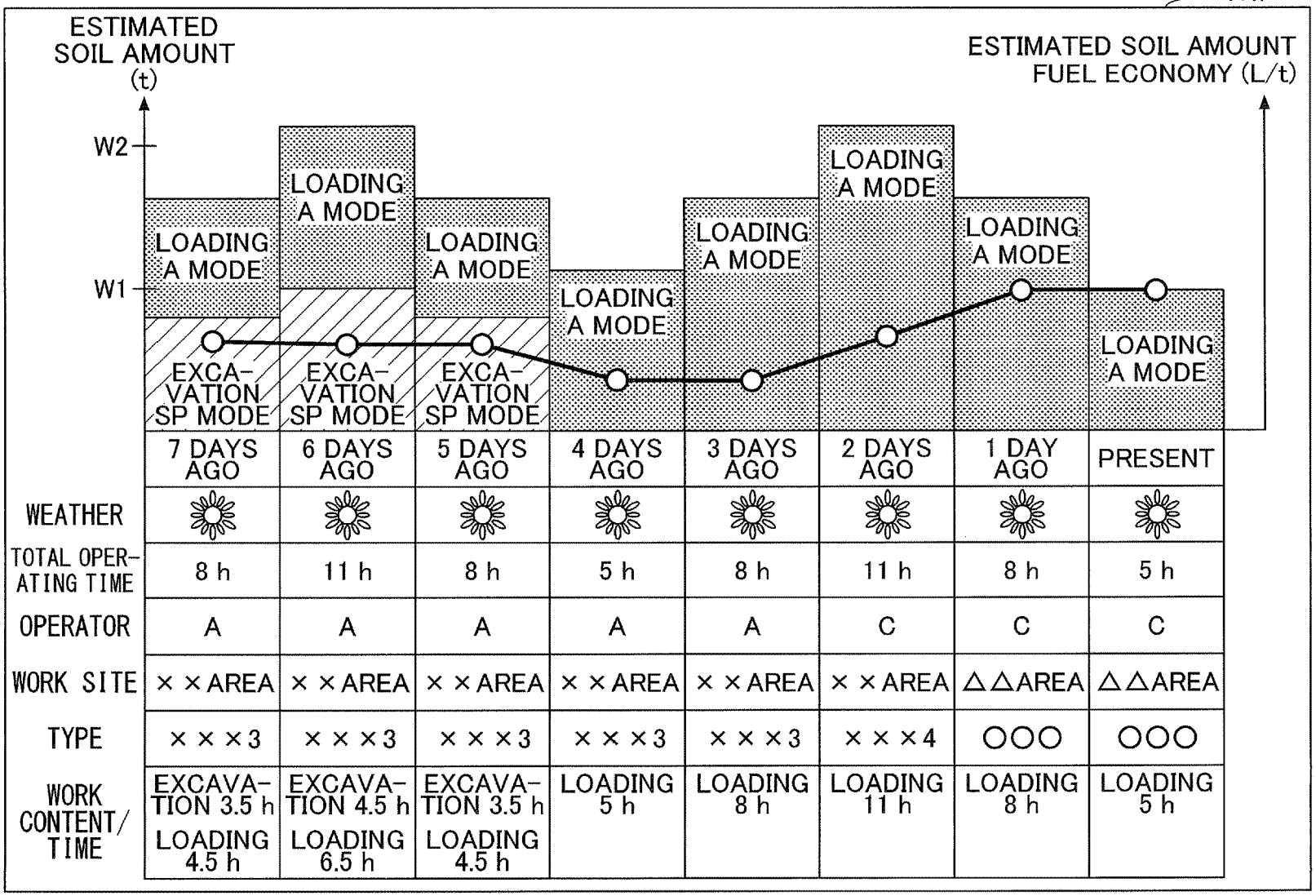
FIG. 10D shows further another example of a work amount displaying screen.

In FIG. 10D, the work amount display screen 41*w* displays the daily transition of estimated soil amount as a bar graph and the daily transition of estimated soil amount fuel economy as a line graph. Then, the work amount display screen 41*w* displays a tabular representation of the type of work, speed mode, weather, total operating time, operator, work site, type of excavated material, and operating time of each day. The total operating time means the total running time of the shovel 100, and work content/time means the operating period of time of the shovel 100 for each work item. In addition, the work amount display screen 41*w* changes the bar graph color for each work, and displays the information on the rotation speed mode selected for each work content in the bar graph. The rotation speed modes include, for example, an SP mode, an H mode and an A mode in descending order of RPM of the engine 11.

Specifically, the work amount display 41*w* indicates, for example, that for work seven days ago, the weather was "fine"; the total operating time was "eight hours"; the operator was "A"; the work place was "xxxxxxx3"; the type of excavation object was "xxxx3"; the excavation in the SP mode was performed for 3.5 hours; and the loading operation in the A mode was performed for 4.5 hours. The work amount display 41*w* indicates, for example, that the weather was "fine" for the work one day ago, the total operating time was "eight hours," the operator was "C," the work area was "ΔΔΔ" and the type of excavated material was "○○○", and the loading operation in the A mode was performed for eight hours.

The administrator who viewed the work amount display screen 41*w* can confirm, for example, that the breakdown of 11 hours of total operating time six days ago was 4.5 hours of excavation and 6.5 hours of loading. In other words, the administrator can clearly understand the percentage of each type of work in the daily work hours.

In addition, the administrator who looked at the work amount display screen 41*w* can confirm that the fuel economy is improved compared to that five days ago because only the loading operation is performed without the excavation operation, for example, for the work four days and three days ago.

In addition, the administrator who looks at the work amount display screen 41*w* can confirm, for example, that the operator changed from "A" to "C" two days ago and that the fuel economy deteriorated from three days ago.

Furthermore, the administrator who looked at the work amount display screen 41*w* can confirm, for example, that the work place changed from "××district" to "ΔΔΔ" one day ago, the type of excavated material changed from "×××4" to "○○○", and the fuel economy deteriorated from two days ago.

Figure 10E:
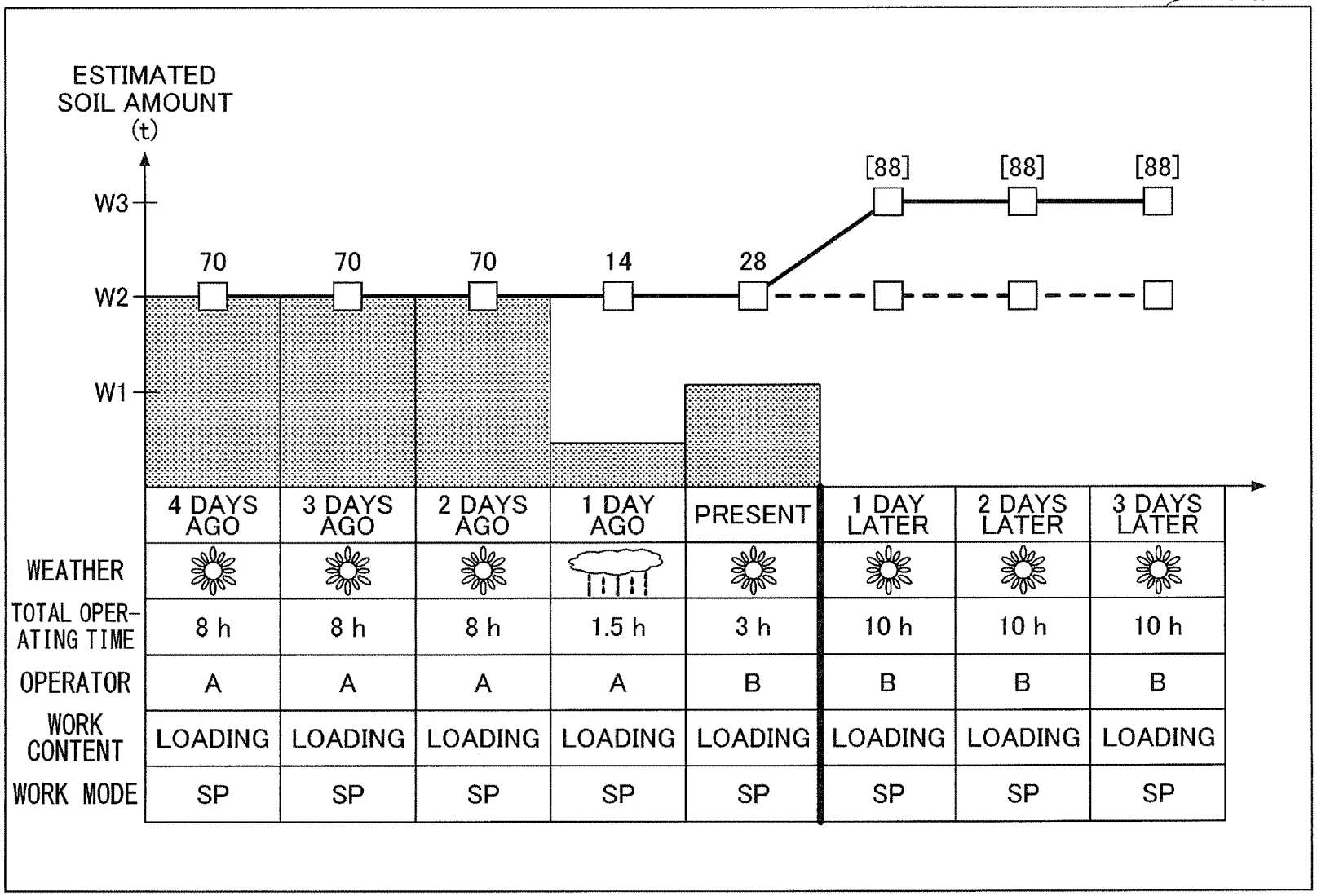
FIG. 10E shows further another example of a work amount displaying screen.

In FIG. 10E, the work amount display screen 41*w* displays the daily transition of estimated soil amount as a bar graph and the daily transition of target value (planned value) of the amount of work (estimated soil amount) as a line graph. The solid line represents the target value (planned value) after the plan change, and the dashed line represents the target value (planned value) before the plan change. Then, the work amount display screen 41*w* displays the weather each day, the total operating time, the operator, the type of the work, and the speed mode in a tabular format. In addition, the work amount display screen 41*w* displays the number of dump trucks used to carry out excavated materials on a bar graph.

Specifically, the work amount display screen 41*w* indicates, for example, that the weather was "fine," the total operating time was "8 hours," the operator was "A," the type of the work was "loading (operation)," and the speed mode was "SP," the target value of the amount of work per day was W2 [t], the actual amount of work (estimated soil volume) was the same as the target value of W2 [t], and that the excavated materials were carried out from the work site by the dump trucks of 70 cars.

The work amount display screen 41*w* indicates, for example, that two days later, the weather is "fine," the total operating time is "10 hours," the operator is "B," the work content type is "loading (operation)," and the speed mode is "SP." In addition, the target value of the amount of work per day is changed from W2 [t] to W3 [t], and 88 dump trucks are required to carry out the excavated materials from the work site.

In the example of FIG. 10E, information about the past (4 days to 1 day ago) and the present represents results, and information about the future represents a forecast.

The administrator who looked at the work amount display screen 41*w* can confirm, for example, that the loading of excavated materials into the dump truck was carried out as planned for operations four days to two days ago. The administrator can also confirm that the loading of excavated material into the dump truck was not carried out as intended due to rain for the work one day ago. In addition, the administrator can confirm that the excavated materials (earth and sand) were not carried out because part of the excavated materials (earth and sand) was not dried even though it was sunny, and that the loading of the excavated materials into the dump truck was not carried out according to the target.

In addition, the administrator who viewed the work amount display screen 41*w* can confirm that the target value of the amount of work per day has been raised from W2 [t] to W3 [t] after tomorrow (one day later) in order to recover the work delay. In addition, brackets enclosing the number of units indicate the value after the change.

As a result, the administrator can check the amount of loaded soil (amount of work) per day required to recover the delay in the process and the number of dump trucks used to carry it out at the same time, and it is also confirmed that the reason for the change in the planed value is due to the change in the weather. The work amount display screen 41*w* may display not only weather-related information but also mechanical-related information. The mechanical state is at least one of "normal," "minor failure," and "abnormal," for example. If an "Error" is displayed as the machine condition, the administrator can see that the decrease in the amount of work is caused by an error in the machine (shovel 100). In addition, the work amount display screen 41*w* may indicate the work site condition. The work site condition is at least one of the following: "operator's rest," "accident," "machine transfer," "wrong material distribution," and "investigation (survey)." The administrator who looked at the work site condition finds that the decrease in the work amount was caused by changes in the work site conditions, such as the occurrence of an "accident."

Figure 10F:
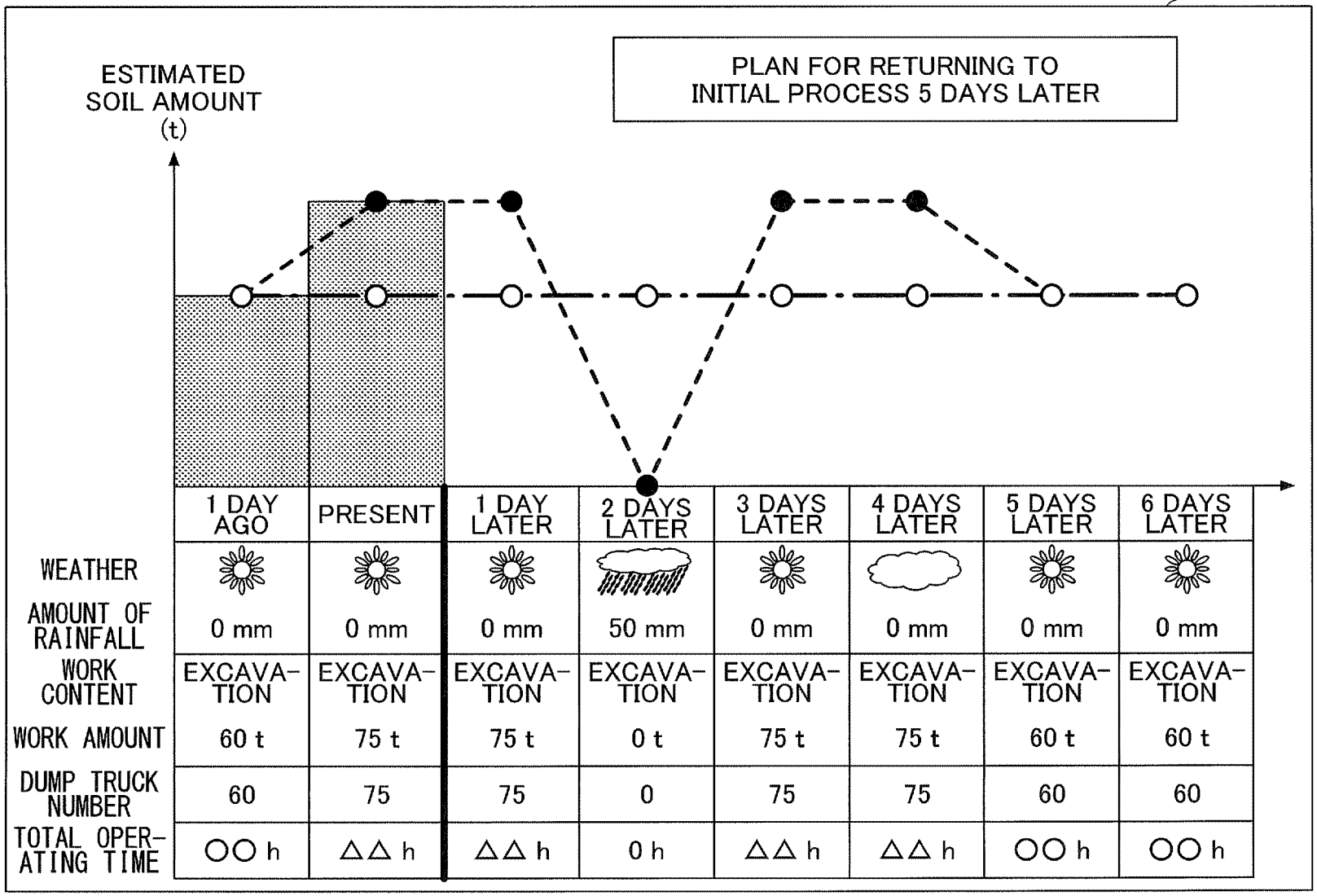
FIG. 10F shows further another example of a work amount displaying screen.

In FIG. 10F, the work amount display screen 41*w* displays the daily transition of estimated soil amount as a bar graph and the daily transition of target value (planned value) of the workload (estimated soil amount) as a line graph. Then, on the work amount display screen 41*w*, the number of dump trucks and the total work hours related to the weather, amount of rainfall, type of work, work amount (estimated soil amount), and excavated materials are displayed in a tabular format. The work amount display screen 41*w* shows the transition of the initial target value of the amount of work set before starting a construction (the transition before the plan change) in open circles and dashed and dotted lines, and shows the transition of the target value of the amount of work after the change based on the current weather forecast (the transition after changing the plan) in black circles and broken lines.

Specifically, the work amount display 41*w* shows, for example, that for the work one day ago, the weather was "fine," the amount of rainfall was "0 mm," the type of work was "excavation (operation)," the work amount was "60 tons," the number of dump trucks related to the carry-out of the excavated material was "60 units," and the total operating time was "xx hours," and the target value of the amount of work per day was W2 [t], and the actual amount of work (estimated soil volume) was the same as the target value W2 [t].

The work amount display 41*w* shows, for example, that for today's work, the weather was "fine" and the rainfall was "0 mm," the type of work was "excavation (operation)," the workload was "75 tons," the number of dump trucks used for carrying out the excavated material was "75 units" and the total operating time was "ΔΔ hours," the target value for the daily workload was W2[t], and the actual amount of work (estimated soil volume) was W3[t] higher than the target value.

The work amount display 41*w* indicates, for example, that two days later, the weather is "rain" and the amount of rainfall is "50 mm," the work type is "excavation (operation)," the amount of work is "0 tons," the number of dump trucks used for carrying out the excavated material is "0 trucks," and the total operating time is "0 hours," and the target value of the amount of work per day is changed from W2 [t] to 0 [t].

In the example shown in FIG. 10F, information about the past (one day ago) and the present represents actual results, and information about the future represents forecasts.

FIG. 10F shows an example in which a change in the construction plan (target value of amount of work) was made one day ago (the previous day). The change is based on a forecast that a heavy rainfall will occur in two days. In this case, the amount of work is expected to be zero two days later, but it is expected to return to the initial process (target value of the amount of work) five days later. Therefore, the construction plan has been changed so that the target value (planned value) is higher than the original target value (planned value) from the present (today).

The result that the actual work volume (estimated soil volume) today is higher than the target value is due to the automatic change of the construction plan (target value of the work volume) based on the weather forecast after tomorrow. The example in FIG. 10F shows that the actual work was performed according to the plan after this change. In the example of FIG. 10F, the controller 30 considers the heavy rainfall forecast two days later and sets a target of zero work amount two days later. That is, the controller 30 stops working two days later. Accordingly, the controller 30 allocates and adds up the amount of work that should have been achieved in two days' work in the preceding four days. To restore the target value of the amount of work to the original target value five days later. Such a change in the construction plan is performed automatically, for example, when information on the date when the delay in the work is eliminated (five days later in the example of FIG. 10F) and the maximum amount of work per day (W3[t] in the example of FIG. 10F), is input. However, changes to the construction plan may be made manually by an operator or administrator of the shovel 100. For example, the operator or administrator of the shovel 100 may individually change the target value of the daily work amount. If the administrator requests a plan to return to the initial process after eight days, the additional daily work is calculated less than the example shown in FIG. 10F. Thus, the controller 30 can modify the plan according to the input return request date (five days later in the example of FIG. 10F).

In the example of FIG. 10F, as in the example of FIG. 10E, the work amount display screen 41*w* may display at least one information, such as a mechanical condition and a work site condition, in addition to weather information. As a result, the administrator can clearly understand the relationship between the disturbance element of the work and the amount of work when viewing the work amount display screen 41*w*. The administrator can then modify the construction plan while considering disturbance factors. In addition, the administrator may enter at least one of the types, densities, and amount of work (for example, soil volume) of the excavated material so that the controller 30 can calculate the number of dump trucks required to carry the excavated material out.

In the embodiment described above, the date field includes "one day ago" and "one day later," and the like, but a specific date such as "Sep. 1, 2017" may be displayed.

The work amount display screen 41*w* may be displayed on the display device 40 mounted on the shovel 100, may be displayed on the display unit of the management device D1, or may be displayed on the display unit of the support device D2. In this case, the total soil (amount of work) of the multiple shovels may be calculated and displayed. The number of dump trucks at this time may be calculated and displayed individually corresponding to the amount of work of each of the plurality of shovels at the work site. The total soil content may be calculated and displayed based on the data of all shovels at the work site.

In the above example, the work amount display screen 41*w* displays the work amount information in a bar graph or a combination of a bar graph and a line graph, although other graphs, such as a scatter graph, may be used to display the work amount information.

In addition, the work amount display screen 41*w* includes a graph indicating the transition of the estimated soil amount. However, in the case where a graph indicating the transition of the estimated soil amount fuel economy is included as shown in FIGS. 10B to 10D, a graph indicating the transition of the estimated soil amount may be omitted. It is also possible to display a combination of a graph showing changes in fuel consumption and a graph showing changes in estimated soil fuel consumption.

Figure 11:
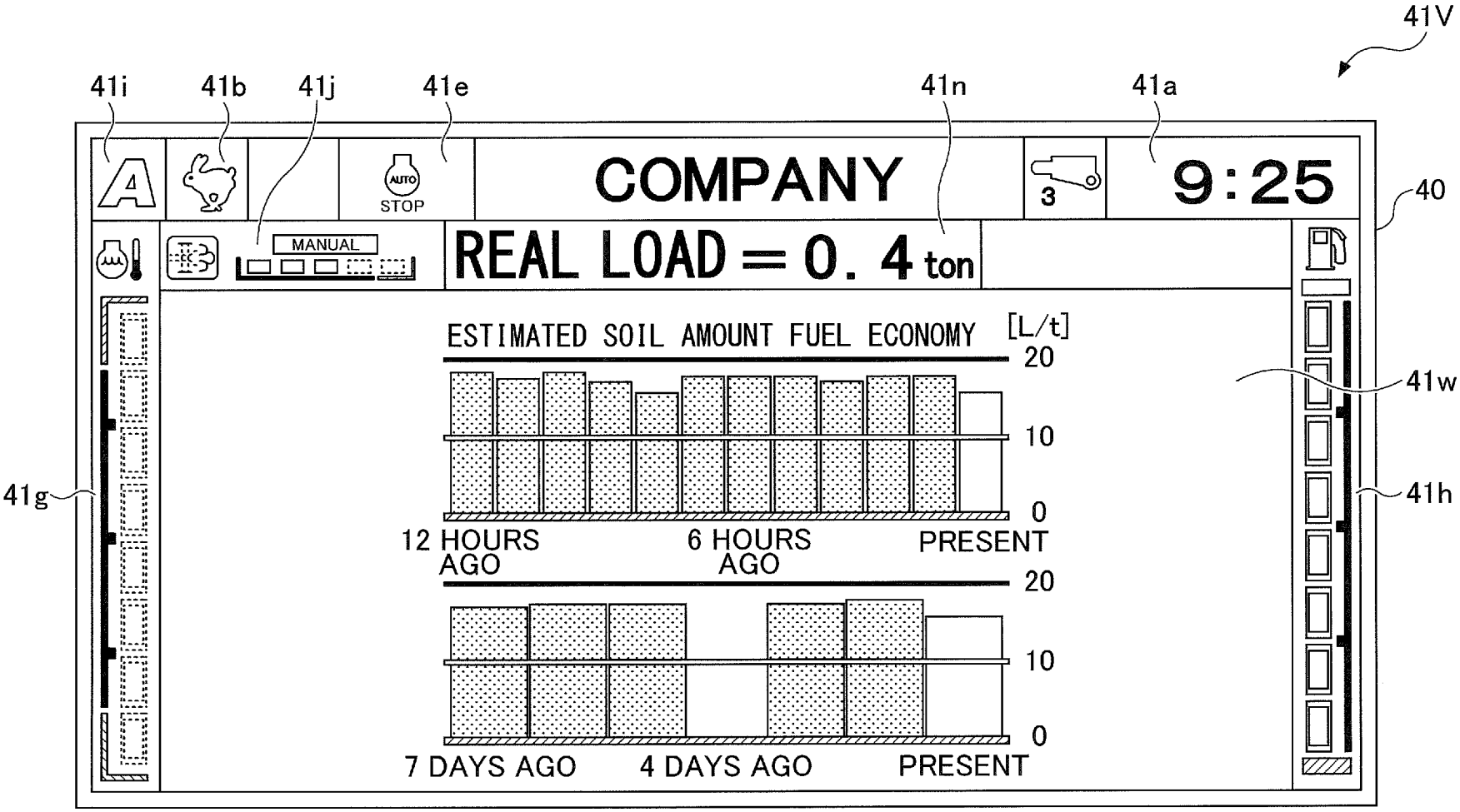
FIG. 11 shows another example of a main screen displayed on a display device.

FIG. 11 is another example of the main screen 41V displayed in the display device 40 and corresponds to FIG. 9. The main window 41V of FIG. 11 differs from the main window 41V of FIG. 9 in that the work amount display screen 41*w* principally displays the transition of estimated soil fuel economy in the upper and lower bar graphs and has the arm load display region 41*n*. In the example of FIG. 11, the vertical axis of the bar graph corresponds to the estimated soil fuel economy. The unit of estimated soil fuel economy is [L/t]. The upper bar graph shows the trend of estimated soil fuel consumption every hour, and the lower bar graph shows the trend of estimated soil fuel consumption every day.

The arm load display region 41*n* is an example of the operation status display region and indicates the load magnitude applied to the tip of the arm 5. In the example of FIG. 11, the arm load display region 41*n* indicates "actual load=0.4 ton." By viewing this indication, the operator can see that 0.4 tons of weight is applied to the tip of the arm 5. The load applied to the tip of arm 5 is calculated, for example, based on the output of the cylinder pressure sensor.

Figure 12:
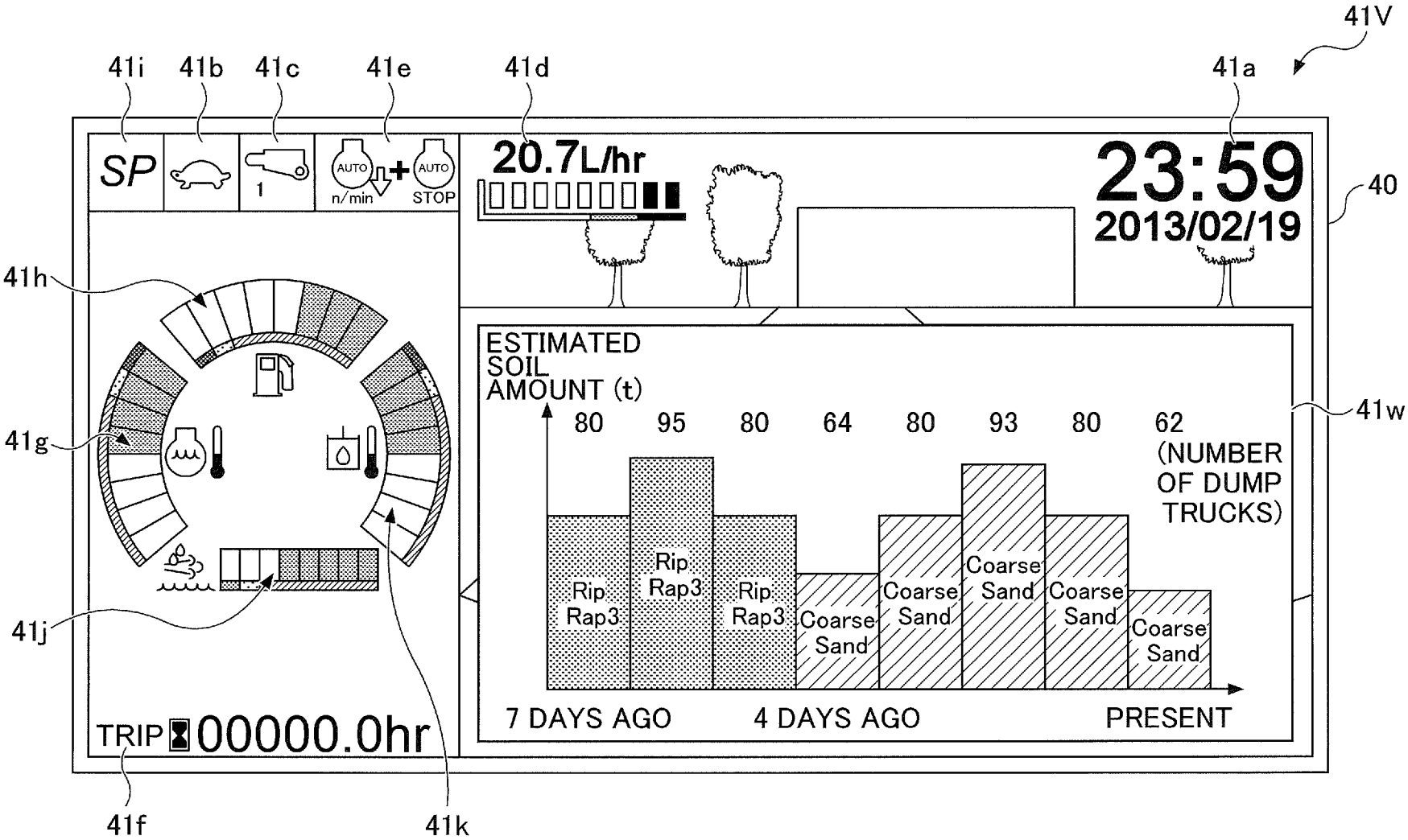
FIG. 12 shows another example of a main screen displayed on a display device.

FIG. 12 is another example of the main screen 41V displayed in the display device 40 and corresponds to FIG. 9. The work amount display screen 41*w* of FIG. 12 differs from the work amount display screen 41*w* of FIG. 9 in that the number of dump trucks related to the daily workload is displayed on the bar graph; information on the type of excavated material is displayed on the bar graph; and that the pattern of the bar graph is changed for each type of excavated material. The type of excavation includes, for example, "RipRap3" and "Coarse Sand" as material symbols (material types).

In the example of FIG. 12, the workload display screen 41*w* displays the number of dump trucks per day that carried out the estimated amount of soil from the work site. Specifically, the workload display screen 41*w* shows that the excavated material (RipRap3) represented by the estimated soil amount seven days ago was carried out from the work site by 80 dump trucks, and the excavated material (RipRap3) represented by the estimated soil amount six days ago was carried out from the work site by 95 dump trucks. The same applies to five days ago and four days ago. The number of dump trucks associated with the work amount may be counted based on the information acquired by the information acquiring device and may be calculated from the estimated soil volume.

The work amount display screen 41*w* shows that the type of excavation was "RipRap3" (dump stone or split rock and the like) 7 to 5 days ago before starting the excavation, while the type of excavation was "Coarse Sand" from 4 days ago to the present. The type of excavation may be information input through the input device 42 and may be automatically determined based on the information acquired by the information acquiring device.

As described above, the shovel 100 according to an embodiment of the present invention includes a cabin 10 as an operator's cab, a display device 40 mounted on the cabin 10, a main pump 14, an engine 11 as an internal combustion engine driving the main pump 14, an information acquiring device, and a controller 30 as a control device for calculating a work amount based on information acquired by the information acquiring device and displaying a predetermined work amount on the display device 40 in a time series. The amount of work is, for example, the estimated amount of soil that is an estimate of the volume or weight of earth and sand as excavated material. The unit of amount of work may or may not be displayed. The unit of volume displayed may be, for example, [$m^3$] (cubic meters), but other units such as [L] (liters). Similarly, the unit of weight displayed may be, for example, [t] (tons), but other units such as [kg] (kilograms). The same shall apply to the unit of fuel consumption. With this configuration, the shovel 100 can be presented in an understandable manner by an operator, an administrator, or the like.

The controller 30 may calculate the labor fuel economy based on the information obtained by the information acquiring device. Workload fuel economy is, for example, fuel consumption per unit workload or workload per unit fuel consumption. The controller 30 may then cause the display device 40 to display the amount of fuel consumption every predetermined time in chronological order. The work amount fuel economy may be, for example, estimated soil mass per unit fuel consumption. In this case, the estimated soil volume may be an estimate of the volume of soil as excavated material or an estimate of the weight of soil as excavated material.

The work amount fuel economy may be, for example, fuel consumption per unit estimated soil volume as shown in FIG. 10C. In this case, the estimated amount of soil may be an estimate of the volume of soil as excavated material or an estimate of the weight of soil as excavated material.

The operator of the shovel 100 cannot determine the quality of the work performed by himself/herself by looking at the time change of fuel consumption per unit time. This is because the fuel consumption greatly varies depending on the amount of work. On the other hand, the operator can determine the quality of his/her own work based on the work amount fuel economy. This is because the work amount fuel consumption reflects the volume of work. As described above, the shovel 100, which displays the work amount fuel economy in chronological order on the display device 40, can present the contents of the work performed by the operator in an easy-to-understand manner to the operator, thereby encouraging the operator to improve the work efficiency. In addition, instead of displaying the time-course of the work amount fuel economy for each predetermined hour, the time-course of the work amount for each predetermined hour and the time-course of the fuel consumption for each predetermined hour may be simultaneously displayed.

As shown in FIG. 3, the controller 30 may calculate a workload based on a topographic change derived from an image taken by a three-dimensional range image sensor S6A as an example of an imaging device S6. The controller 30 may calculate a work amount based on an attitude of an attachment derived from information acquired by the information acquiring device or a change thereof, as shown in FIG. 7. Further, as shown in FIG. 8, the controller 30 may calculate the volume of the excavated material in the bucket 6 as the work amount based on the image of the bucket 6 taken by the front camera S6F as the imaging device S6, which is an example of the spatial recognition device. The controller 30 may calculate the weight of the excavated material in the bucket 6 as a work amount based on the pressure of the hydraulic oil in the hydraulic cylinder constituting the attachment. For example, the controller 30 may calculate the weight of the excavated material in the bucket 6 as the work amount based on the boom bottom pressure which is the pressure of the hydraulic oil in the bottom oil chamber of the boom cylinder 7 constituting the excavation attachment.

The controller 30 may cause the display device 40 to display the number of dump trucks associated with the work amount, as shown in FIG. 12, or may cause the display device 40 to display information about the type of excavation. For example, information about the type of excavation may be displayed on a bar graph.

The controller 30 may simultaneously display work amount based on the weight of the excavated material and work amount based on the volume of the excavated material. For example, the time-course of the estimated soil quantity expressed in units [t] and the time-course of the estimated soil quantity expressed in units [$m^3$] may be simultaneously displayed on the display device 40. The controller 30 may also simultaneously display work amount fuel economy based on the weight of the excavated material and work amount fuel economy based on the volume of the excavated material. For example, the controller 30 may simultaneously display a time transition of estimated soil amount fuel economy expressed in units [L/t] and a time transition of estimated soil amount fuel economy expressed in units [L/m3] on the display device 40.

The preferred embodiment of the present invention has been described in detail above. However, the invention is not limited to the embodiments described above. Various modifications, substitutions, and the like may be applied to the embodiments described above without departing from the scope of the invention. Also, the features described separately may be combined unless there is a technical inconsistency.

For example, in the embodiments described above, the controller 30 is configured to display information about work amount on the display device 40 located within the cabin 10, but may be configured to display the display device outside of the cabin 10. For example, the controller 30 may be configured to transmit information regarding the workload to the outside through the communication device T1 so that the display device connected to the management device D1 installed in an external facility such as the management center or the display device incorporated in a portable terminal as the support device D2 such as a smartphone, displays information regarding the work amount.

Thus, according to the above-mentioned embodiments, a shovel that can present how a shovel is used in a more understandable manner can be provided.

What is claimed is:

1. A shovel, comprising:

a lower traveling body;

an upper turning body rotatably mounted on the lower traveling body;

a cabin provided on the upper turning body;

an attachment attached to the upper turning body, the attachment including a boom, an arm, and an end attachment;

a display device attached to the cabin;

a main pump provided on the upper turning body;

a power source provided on the upper turning body and configured to drive the main pump;

an information acquiring device configured to acquire information; and a hardware processor configured to calculate an amount of work per predetermined period of time based on the information acquired by the information acquiring device and to cause the display device to display the amount of work calculated per the predetermined period of time in a chronological order, the amount of work being a cumulative value of volumes, a cumulative value of weights, or a combination thereof of a material excavated with the attachment, the volumes being calculated one for each of a plurality of excavations performed within the predetermined period, the weights being calculated one for each of the plurality of excavations performed within the predetermined period.

2. The shovel as claimed in claim 1, wherein the hardware processor is configured to calculate a work amount fuel economy based on the information acquired by the information acquiring device, and to cause the display device to display the work amount fuel economy per the predetermined period of time in the chronological order, the work amount fuel economy being a fuel consumption per unit amount of work or an amount of work per unit fuel consumption.

3. The shovel as claimed in claim 1, wherein the hardware processor is configured to calculate each of the volumes of the excavated material per the predetermined period of time based on a change in landform derived from an image taken by an imaging device.

4. The shovel as claimed in claim 1, wherein the end attachment is a bucket, and the hardware processor is configured to calculate each of the volumes of the excavated material in the bucket based on an image of the bucket taken by an imaging device.

5. The shovel as claimed in claim 1, wherein the hardware processor is configured to calculate each of the volumes of the excavated material based on a change in attitude of the attachment derived from the information acquired by the information acquiring device.

6. The shovel as claimed in claim 1, wherein the end attachment is a bucket, and the hardware processor is configured to calculate each of the weights of the excavated material in the bucket based on a pressure of a hydraulic oil in a hydraulic cylinder configured to drive the attachment.

7. The shovel as claimed in claim 1, wherein the hardware processor is configured to cause the display device to display a number of dump trucks relating to the amount of work.

8. The shovel as claimed in claim 1, wherein the amount of work is the cumulative value of the volumes and the cumulative value of the weights, and the hardware processor is configured to cause the display device to simultaneously display the cumulative value of the volumes and the cumulative value of the weights.

9. The shovel as claimed in claim 1, wherein the hardware processor is configured to cause the display device to simultaneously display a first work amount fuel economy based on the calculated weights of the excavated material per the predetermined period of time and a second work amount fuel economy based on the calculated volumes of the excavated material per the predetermined period of time.

10. The shovel as claimed in claim 1, wherein the hardware processor is configured to cause the display device to display information about a type of the excavated material.

11. A support device used for a shovel, the shovel including a lower traveling body, an upper turning body rotatably mounted on the lower traveling body, an attachment attached to the upper turning body, the attachment including a boom, an arm, and an end attachment, a main pump provided on the upper turning body, a power source provided on the upper turning body and configured to drive the main pump, an information acquiring device configured to acquire information, and a hardware processor configured to calculate an amount of work per predetermined period of time based on the information acquired by the information acquiring device, the support device comprising:

a display device; and a hardware processor configured to receive the amount of work calculated per the predetermined period of time from the shovel and cause the display device to display the amount of work calculated per the predetermined period of time in a chronological order, the amount of work being a cumulative value of volumes, a cumulative value of weights, or a combination thereof of a material excavated with the attachment, the volumes being calculated one for each of a plurality of excavations performed within the predetermined period, the weights being calculated one for each of the plurality of excavations performed within the predetermined period.

12. The support device as claimed in claim 11, wherein the hardware processor of the support device is configured to cause the display device to display a work amount fuel economy per the predetermined period of time in the chronological order, the work amount fuel economy being a fuel consumption per unit amount of work or an amount of work per unit fuel consumption calculated based on the information acquired by the information acquiring device.

13. The support device as claimed in claim 11, wherein the hardware processor of the support device is configured to cause the display device to display a number of dump trucks relating to the amount of work.

14. The support device as claimed in claim 11, wherein the hardware processor of the support device is configured to cause the display device to display information about a type of the excavated material.

15. A management device used for a shovel, the shovel including a lower traveling body, an upper turning body rotatably mounted on the lower traveling body, an attachment attached to the upper turning body, the attachment including a boom, an arm, and an end attachment, a main pump provided on the upper turning body, a power source provided on the upper turning body and configured to drive the main pump, an information acquiring device configured to acquire information, and a hardware processor configured to calculate an amount of work per predetermined period of time based on the information acquired by the information acquiring device, the management device comprising:

a display device; and a hardware processor configured to receive the amount of work calculated per the predetermined period of time from the shovel and cause the display device to display the amount of work calculated per the predetermined period of time in a chronological order, the amount of work being a cumulative value of volumes, a cumulative value of weights, or a combination thereof of a material excavated with the attachment, the volumes being calculated one for each of a plurality of excavations performed within the predetermined period, the weights being calculated one for each of the plurality of excavations performed within the predetermined period.

16. The management device as claimed in claim 15, wherein the hardware processor of the management device is configured to cause the display device to display a work amount fuel economy per the predetermined period of time in the chronological order, the work amount fuel economy being a fuel consumption per unit amount of work or an amount of work per unit fuel consumption calculated based on the information acquired by the information acquiring device.

17. The management device as claimed in claim 15, wherein the hardware processor of the management device is configured to cause the display device to display a number of dump trucks relating to the amount of work.

18. The management device as claimed in claim 15, wherein the hardware processor of the management device is configured to cause the display device to display information about a type of the excavated material.

* * * * *